US007881633B2

(12) United States Patent
Sakuma

(10) Patent No.: US 7,881,633 B2
(45) Date of Patent: Feb. 1, 2011

(54) DEVELOPER CARTRIDGE, DEVELOPING DEVICE AND IMAGE FORMING APPARATUS

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 178 days.

(21) Appl. No.: 12/210,311

(22) Filed: Sep. 15, 2008

(65) Prior Publication Data

US 2009/0087216 A1 Apr. 2, 2009

(30) Foreign Application Priority Data

Oct. 2, 2007 (JP) ..... 2007-258318

(51) Int. Cl.
*G03G 15/08* (2006.01)

(52) U.S. Cl. ..... 399/106; 399/262; 399/263

(58) Field of Classification Search ..... 399/103, 399/106, 256, 262, 263
See application file for complete search history.

(56) References Cited

U.S. PATENT DOCUMENTS

| | | | | |
|---|---|---|---|---|
| 4,937,628 | A * | 6/1990 | Cipolla et al. | 399/106 |
| 5,508,794 | A | 4/1996 | Ikesue et al. | |
| 5,548,384 | A * | 8/1996 | Weed | 399/106 X |
| 5,722,019 | A * | 2/1998 | Nakajima | 399/262 |
| 5,890,034 | A * | 3/1999 | Nakano et al. | 399/106 |
| 5,913,097 | A * | 6/1999 | Nakano et al. | 399/256 |
| 6,324,371 | B1 * | 11/2001 | Okiyama et al. | 399/262 |
| 7,266,330 | B2 * | 9/2007 | Murakami et al. | 399/262 |
| 2002/0025192 | A1 | 2/2002 | Matsuda et al. | |
| 2005/0135842 | A1 * | 6/2005 | Murakami et al. | 399/262 |
| 2006/0034644 | A1 | 2/2006 | Ishii | |
| 2007/0189811 | A1 | 8/2007 | Sato | |
| 2007/0212115 | A1 | 9/2007 | Kunihiro et al. | |
| 2007/0212120 | A1 | 9/2007 | Sato | |

FOREIGN PATENT DOCUMENTS

| | | |
|---|---|---|
| JP | 09-319202 | 12/1997 |
| JP | 11-223990 A | 8/1999 |

(Continued)

OTHER PUBLICATIONS

JP Office Action Oct. 8, 2009, JP Appln. 2007-258318, partial English Translation.

(Continued)

*Primary Examiner*—Sandra L Brase
(74) *Attorney, Agent, or Firm*—Banner & Witcoff, Ltd.

(57) ABSTRACT

A developer cartridge includes an outside frame, an inside frame, a first sealing member and a second sealing member. The outside frame includes an outside supply opening and an outside return opening. The inside frame includes a developer chamber for accommodating a developer, an inside supply opening and an inside return opening. The first sealing member is provided around one of the inside return opening and the outside return opening between the inside frame and the outside frame and is contactable with the inside frame and the outside frame with a first contact pressure. The second sealing member is provided around one of the inside supply opening and the outside supply opening between the inside frame and the outside frame and is contactable with the inside frame and the outside frame with a second contact pressure that is greater than the first contact pressure.

17 Claims, 20 Drawing Sheets

FOREIGN PATENT DOCUMENTS

| | | | |
|---|---|---|---|
| JP | 2005-031229 | A | 2/2005 |
| JP | 2005-331617 | A | 12/2005 |
| JP | 2006-053322 | A | 2/2006 |
| JP | 2007-212966 | A | 8/2007 |
| JP | 2007-240571 | A | 9/2007 |
| JP | 2007-241047 | A | 9/2007 |

OTHER PUBLICATIONS

Extended EP Search Report dtd Mar. 16, 2010, EP Appln. 08016245.6.

* cited by examiner

UPPER SIDE
FRONT SIDE
BACK SIDE
LOWER SIDE
UPPER SIDE
FRONT SIDE
RIGHT SIDE
LEFT SIDE
BACK SIDE
LOWER SIDE 81
83
84
86
87
88
89 (47)
89, 90 (47)
90 (47)
91
92
121
122
123
124

DEVELOPER CARTRIDGE, DEVELOPING DEVICE AND IMAGE FORMING APPARATUS

CROSS-REFERENCE TO RELATED APPLICATIONS

This application claims priority from Japanese Patent Application No. 2007-258318 filed on Oct. 2, 2007, the entire subject matter of which is incorporated herein by reference.

TECHNICAL FIELD

Aspects of the present invention relate to an image forming apparatus, a developing device mounted on the image forming apparatus, and a developer cartridge mounted on the developing device.

BACKGROUND

An image forming apparatus such as a laser printer is mounted with a developing device having a developing chamber provided with a developing roller. JP-A-9-319202 describes a related art developing device demountably mounted with a developer cartridge containing a developer.

In the related art developing device, a developer supply opening is formed at a center of the developer cartridge and a pair of developer receiving openings is formed on both sides thereof. An agitation member for agitating the developer is disposed in the developer cartridge.

The developer in the developer cartridge is supplied from the developer supply opening to the developing chamber by the agitation member. In contrast, the developer staying in the developing chamber is returned from the developer receiving opening to the developer cartridge. Accordingly, in the related art developing device, the developer is circulated in the developing device.

SUMMARY

Aspects of the invention provide a developer cartridge that can secure the circulation of a developer between the outside and a developer chamber and prevent the leakage of the developer between a first frame and a second frame, a developing device comprising the developer cartridge, and an image forming apparatus comprising the developing device.

According to a first aspect of the invention, there is provided a developer cartridge comprising: an outside frame comprising: an outside supply opening, and an outside return opening; an inside frame, one of the inside frame and the outside frame being rotatable with respect to another one of the inside frame and the outside frame between an open position and a closed position, the inside frame comprising: a developer chamber for accommodating a developer; an inside supply opening, which is opposed to the outside supply opening when the one of the inside frame and the outside frame is in the open position, for supplying the developer from the developer chamber to an outside of the developer chamber; and an inside return opening, which is opposed to the outside return opening when the one of the inside frame and the outside frame is in the open position, for returning the developer from the outside to an inside of the developer chamber; a first sealing member that is provided around one of the inside return opening and the outside return opening between the inside frame and the outside frame and is contactable with the inside frame and the outside frame with a first contact pressure; and a second sealing member that is provided around one of the inside supply opening and the outside supply opening between the inside frame and the outside frame and is contactable with the inside frame and the outside frame with a second contact pressure that is greater than the first contact pressure.

According to a second aspect of the invention, there is provided a developing device comprising: the developer cartridge according to the first aspect; and a housing comprising: a cartridge housing part to which the developer cartridge is detachably attached; and a developing part comprising a developer holding member that comprises openings formed to be opposed to the inside supply opening and the inside return opening, the developing part configured to receive the developer supplied through the inside supply opening and the openings.

According to a third aspect of the invention, there is provided an image forming apparatus comprising: the developing device according to the second aspect; and a body casing for housing the developing device.

According to the aspects of the invention, by supplying the developer from the developer chamber to the outside through the inside supply opening and the outside supply opening and returning the developer to the developer chamber through the inside return opening and the outside return opening, the circulation of the developer can be secured.

The second contact pressure of the second sealing member disposed around the inside supply opening and the outside supply opening is set to be greater than the first contact pressure of the first sealing member disposed around the inside return opening or the outside return opening. Accordingly, even when the developer is attached to the second sealing member at the time of supplying the developer from the inside supply opening and the outside supply opening to the outside, leakage of the developer between the first frame and the second frame can be prevented.

In contrast, the first contact pressure of the first sealing member is smaller than the second contact pressure of the second sealing member. Accordingly, it is possible to reduce a sliding resistance between the first frame and the second frame, compared with a case where the first contact pressure and the second contact pressure are both set to be equal. Accordingly, usability can be improved.

According to the aspects of the invention, the circulation of the developer in the developing device can be secured, and the leakage of the developer can be prevented.

DETAILED DESCRIPTION

The related art developing device has some disadvantages. In order to prevent leakage of the developer in the related developing device, a sealing member may be disposed around the developer supply opening or the developer receiving opening.

The agitation member helps the developer to pass through the developer supply opening and supplies the developer from the developer supply opening to the developing chamber. Accordingly, the developer is easily attached to the sealing member disposed around the developer supply opening. When the developer is attached to the sealing member, the developer may leak through gaps and the like.

Aspects of the invention provide a developer cartridge that can secure the circulation of a developer between the outside and a developer chamber and prevent the leakage of the developer between a first frame and a second frame, a developing device having the developer cartridge, and an image forming apparatus having the developing device.

Exemplary embodiments of the present invention will be described with reference to the drawings.

I. First Exemplary Embodiment (Image Forming Apparatus)

Figure 1:
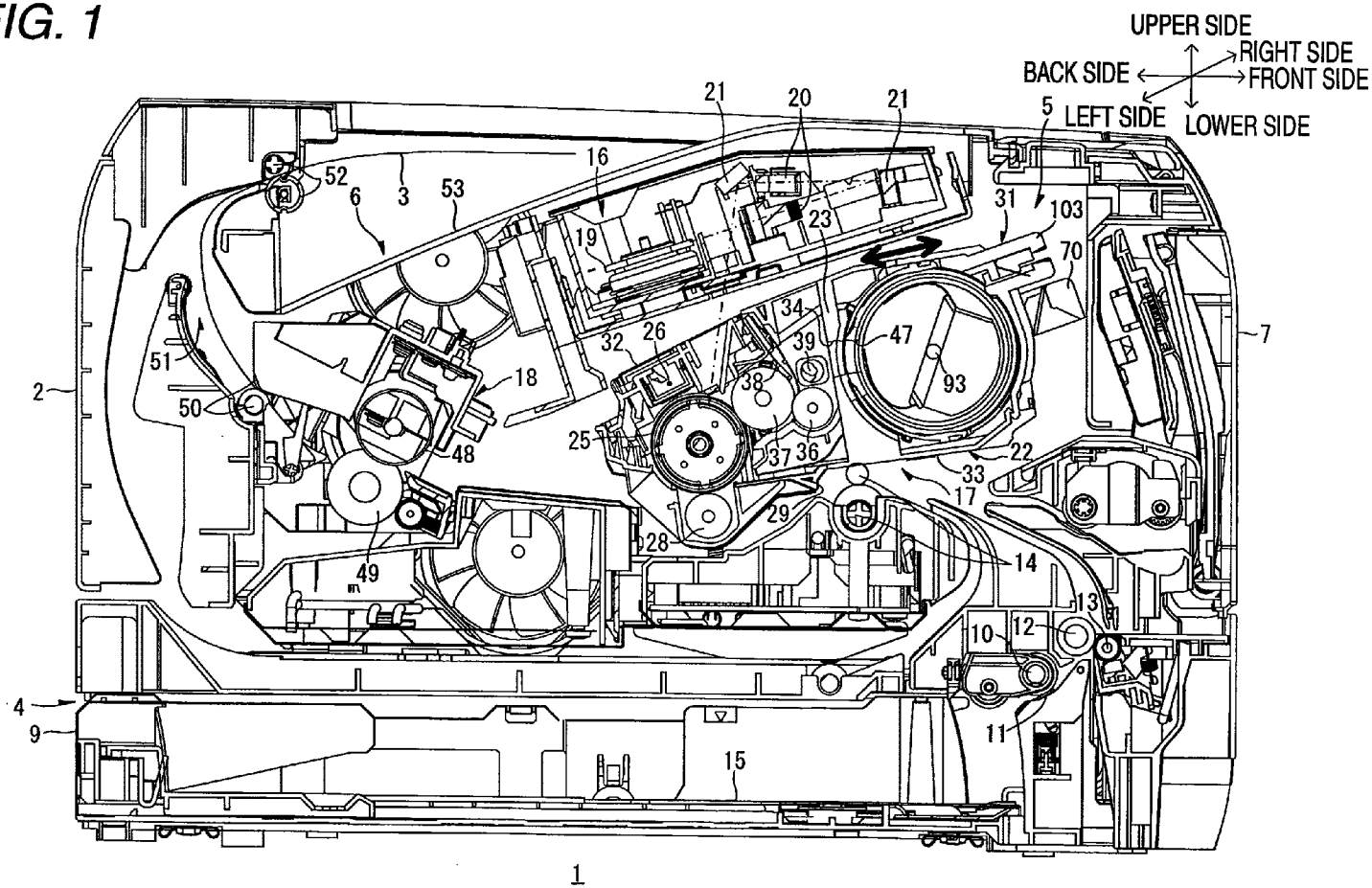
FIG. 1 is a left side sectional view showing an image forming apparatus according to an exemplary embodiment of the invention.
Figures 2A, 2B:
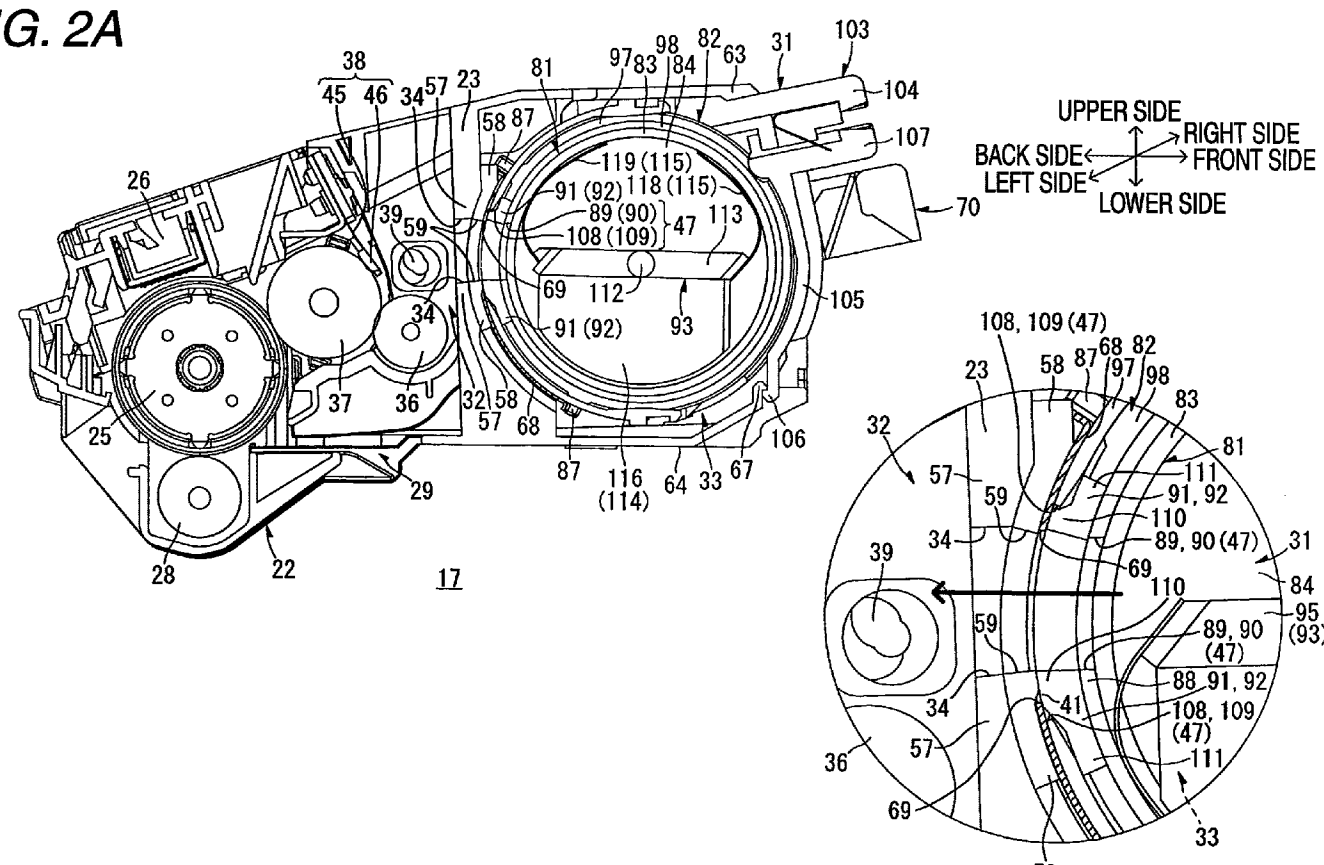
FIG. 2A is a left side sectional view of a process cartridge of the image forming apparatus of FIG. 1, showing a state in which a developer cartridge is attached and a swing arm is located at a pressing position.
FIG. 2B is a partial enlarged view of FIG. 2A.

FIG. 1 is a left side sectional view showing an image forming apparatus according to a first exemplary embodiment of the invention. FIG. 2A is a left side sectional view showing a process cartridge of the image forming apparatus, showing a state where a developer cartridge is attached and a swing arm is located at a pressing position, and FIG. 2B is a partial enlarged view of FIG. 2A.

Referring to FIG. 1, the image forming apparatus 1 includes a feeder unit 4 feeding a sheet 3 into a body casing 2, an image forming unit 5 forming an image on the fed sheet 3, and a sheet discharge part 6 discharging the sheet 3 having the image formed thereon.

(1) Body Casing

The body casing 2 has a box shape and an opening is formed in one side wall thereof. A front cover 7 is provided to open and close the opening. By opening the front cover 7, a process cartridge 17 (to be described later) as an example of a developing device can be attached to and detached from the body casing 2 in the direction indicated by a bald arrow.

In the following description, a side of the image forming apparatus 1 on which the front cover 7 is provided is referred to as a front side (front surface side) and the opposite side is referred to as a back side (back surface side). The outside in the sheet thickness direction of FIG. 1 is referred to as a left side and the deep side in the sheet thickness direction of FIG. 1 is referred to as a right side. The lateral direction and the width direction have the same meaning. In describing a process cartridge 17 (to be described later) and a developer cartridge 31 (to be described later), a state where a frame-side passage hole 34 (to be described later) and a cartridge-side passage hole 47 (to be described later) are opposed to each other substantially in a horizontal direction is a base state.

(2) Feeder Unit

The feeder unit 4 includes a feed tray 9, a feed roller 10, a feed pad 11, paper dust removing rollers 12 and 13, a register roller 14, and a sheet pressing plate 15. A sheet 3 at the uppermost of the sheet pressing plate 15 is separated by the feed roller 10 and the feed pad 11 sheet by sheet, passes through the paper dust removing rollers 12 and 13 and the register roller 14, and is transported to a transfer position (to be described later) of the image forming unit 5.

(3) Image Forming Unit

The image forming unit 5 includes a scanner unit 16, a process cartridge 17, and a fixing part 18.

(3-1) Scanner Unit

The scanner unit 16 is disposed in an upper portion of the body casing 2 and includes a laser emitting portion (not shown), a polygon mirror 19 rotationally driven, a plurality of lenses 20, and a plurality of reflective mirrors 21. As indicated by a dot-chained line, a laser beam emitted from the laser emitting portion on the basis of image data is reflected by the polygon mirror 19, transmitted or reflected by the lenses 20 and the reflective mirrors 21, and is applied to the surface of a photosensitive drum 25 (to be described later) of the process cartridge 17.

(3-2) Process Cartridge

The process cartridge 17 is housed in a space below the scanner unit 16 in the body casing 2 and is detachably attached to the body casing 2.

As shown in FIGS. 2A and 2B, the process cartridge 17 includes a process frame 22 as an example of a housing and a developer cartridge 31.

The process frame 22 monolithically includes a developing part 32 and a cartridge housing part 33 disposed in front of the developing part 32.

The developing part 32 has a substantially box shape extending in the width direction. A partition wall 23 extending in the vertical direction is disposed at the front end portion of the developing part 32. A frame-side passage hole 34 as an example of an opening is formed in the partition wall 23. The developing part 32 communicates with the cartridge housing part 33 through the frame-side passage hole 34. A transfer path 29 extending forward and backward is formed below the developing part 32.

The cartridge housing part 33 extends in the width direction and has a substantially "⊃" shape of which the upper portion and the front portion are opened.

A photosensitive drum 25, a scorotron-type charger 26, a transfer roller 28, a supply roller 36, a developing roller 37 as an example of a developer holding member, a thickness regulating blade 38, and an auger 39 are disposed in the developing part 32. The photosensitive drum 25, the transfer roller 28, the supply roller 36, the developing roller 37, and the auger 39 are rotatably supported by the developing part 32.

The scorotron-type charger 26 is supported above the photosensitive drum 25 by the developing part 32 with a gap from the photosensitive drum 25. The transfer roller 28 is oppositely disposed below the photosensitive drum 25. The developing roller 37 is oppositely disposed in front of the photosensitive drum 25. The supply roller 36 is oppositely disposed in front of the developing roller 37.

The thickness regulating blade 38 includes a thin-plate leaf spring member 45 and a pressing rubber 46 disposed at the lower end of the leaf spring member 45. By fixing the upper end of the leaf spring member 45 to the developing part 32, the pressing rubber 46 presses the surface of the developing roller 37 with an elastic force of the leaf spring member 45.

The auger 39 includes a shaft extending in the width direction and a spiral blade formed on the outer circumferential surface of the shaft and disposed above the supply roller 36 and in back of the frame-side passage hole 34.

The developer cartridge 31 is detachably attached to the cartridge housing part 33. The developer cartridge 31 has a substantially cylindrical shape. The cartridge-side passage hole 47 allowing the inside to communicate with the outside is formed in the developer cartridge 31.

An agitator 93 is rotatably disposed in the developer cartridge 31. A positively chargeable, non-magnetic one component toner as an example of developer is accommodated in the developer cartridge 31.

The developer in the developer cartridge 31 is agitated with the rotation of the agitator 93 and the cartridge-side passage hole 47 and is supplied into the developing part 32 through the frame-side passage hole 34. Thereafter, the developer is transported in the width direction by the auger 39, drops in the middle, and is supplied to the supply roller 36.

Then, the developer is supplied to the developing roller 37 with the rotation of the supply roller 36. At this time, the developer is positively charged between the supply roller 36 and the developing roller 37. Subsequently, the developer enters between the pressing rubber 46 and the developing roller 37 with the rotation of the developing roller 37, is regulated in thickness therebetween, and is held as a thin layer on the surface of the developing roller 37.

The surface of the photosensitive drum 25 is first positively charged uniform by the scorotron-type charger 26 with the rotation of the photosensitive drum 25 and then is exposed to the laser beam from the scanner unit 16. Accordingly, an electrostatic latent image based on image data is formed on the surface of the photosensitive drum 25. Then, with the rotation of the developing roller 37, the developer held on the surface of the developing roller 37 is supplied to the electrostatic latent image formed on the surface of the photosensitive drum 25 at the time of coming in contact with the photosensitive drum 25. Accordingly, the electrostatic latent image is developed (visualized) and a developer image is held on the surface of the photosensitive drum 25. The developer image is transferred onto the sheet 3 passing between the photosensitive drum 25 and the transfer roller 28 (transfer position) in the transfer path 29.

(3-3) Fixing Part

The fixing part 18 is disposed in back of the process cartridge 17 as shown in FIG. 1. The fixing part 18 includes a heating roller 48, a pressurizing roller 49 pressed against the heating roller 48 from the downside, and a pair of transport rollers 50 disposed in the back thereof.

The fixing part 18 thermally fixes the developer transferred onto the sheet 3 at the transfer position while the sheet 3 passes between the heating roller 48 and the pressurizing roller 49. Thereafter, the sheet 3 is transported to a sheet discharge part 6 by the pair of transport rollers 50.

(4) Sheet Discharge Part

The sheet discharge part 6 includes a discharge path 51, a discharge roller 52, and a sheet discharge tray 53. The sheet 3 fed from the fixing part 18 to the sheet discharge part 6 is fed from the discharge path 51 to the discharge roller 52 and is discharged onto the sheet discharge tray 53 by the discharge roller 52.

(Process Frame)

Figures 3A, 3B:
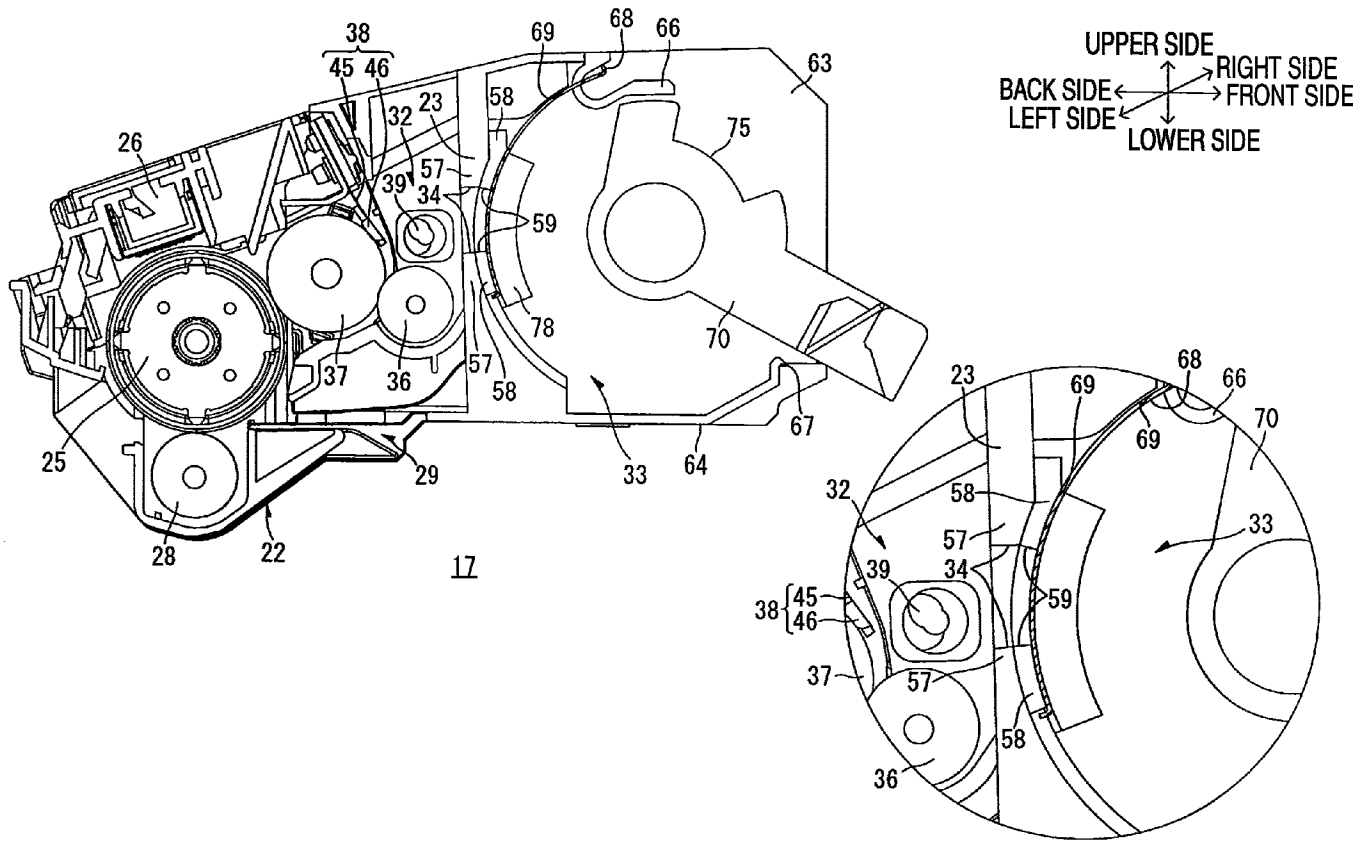
FIG. 3A is a left side sectional view of a process cartridge of the image forming apparatus of FIG. 1, showing a state in which a developer cartridge is detached and the swing arm is located at a press releasing position.
FIG. 3B is a partial enlarged view of FIG. 3A.
Figure 4:
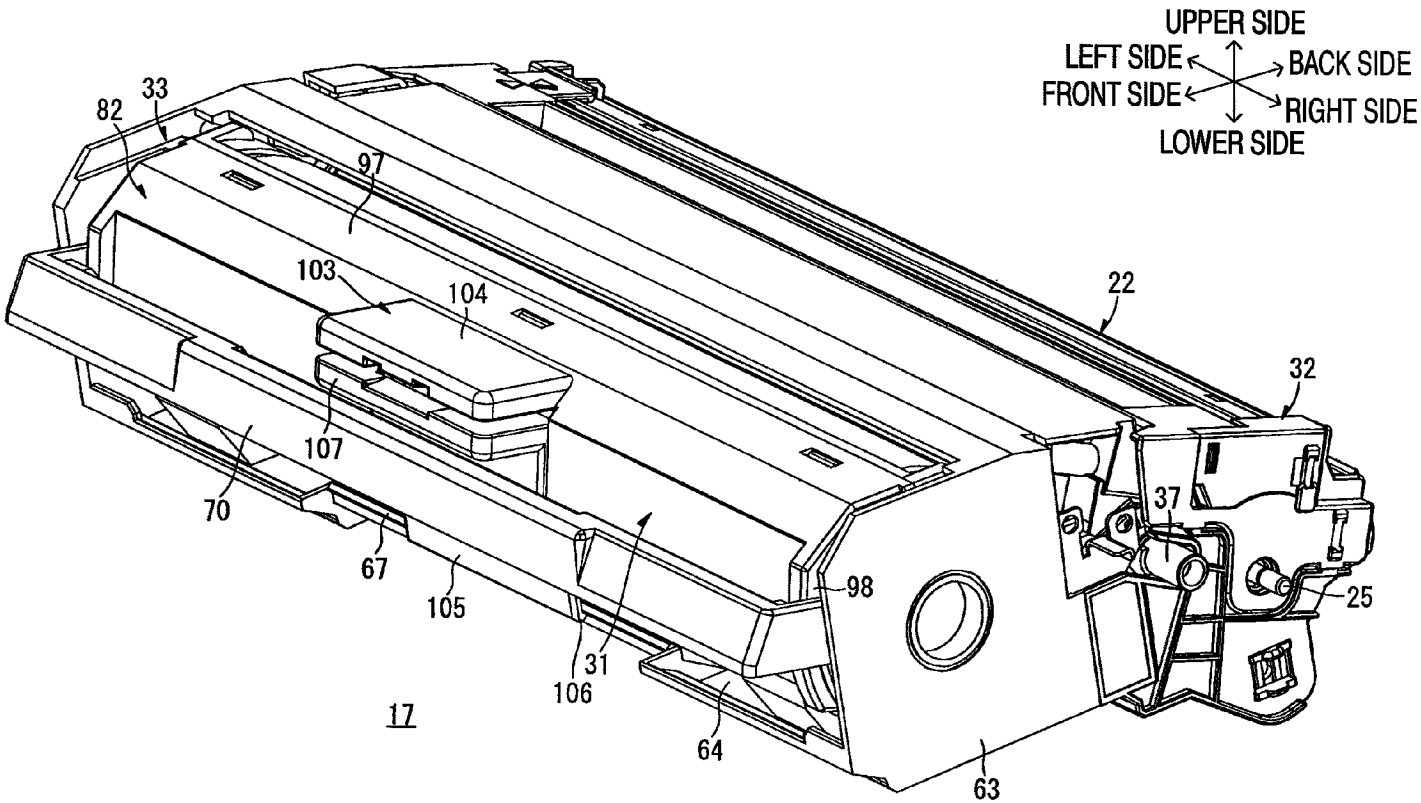
FIG. 4 is a perspective view of the process cartridge shown in FIG. 2A and 2B as obliquely viewed from the front left side.
Figure 5:
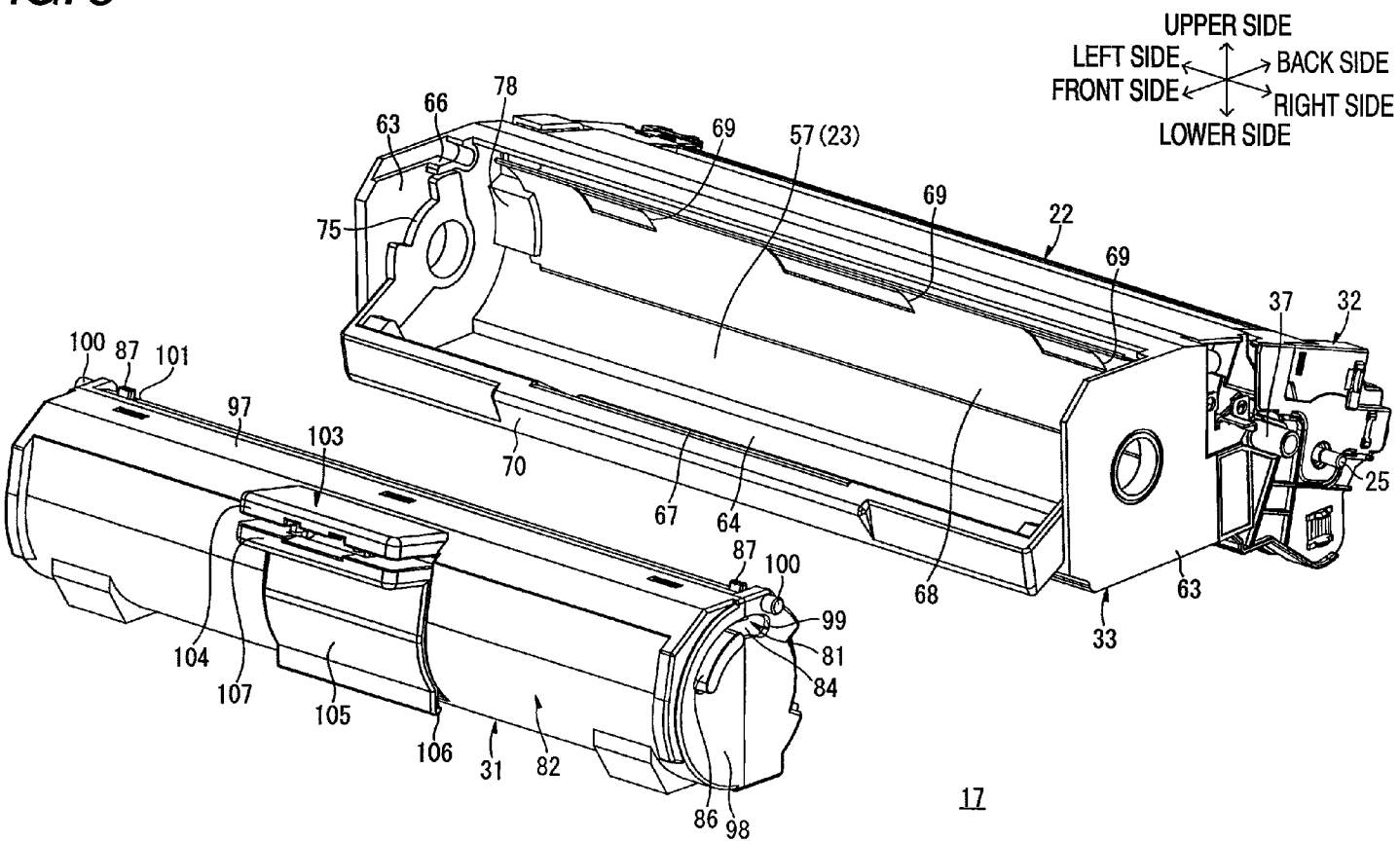
FIG. 5 is an exploded perspective view of the process cartridge of FIG. 4 as obliquely viewed from the front right side.
Figure 6:
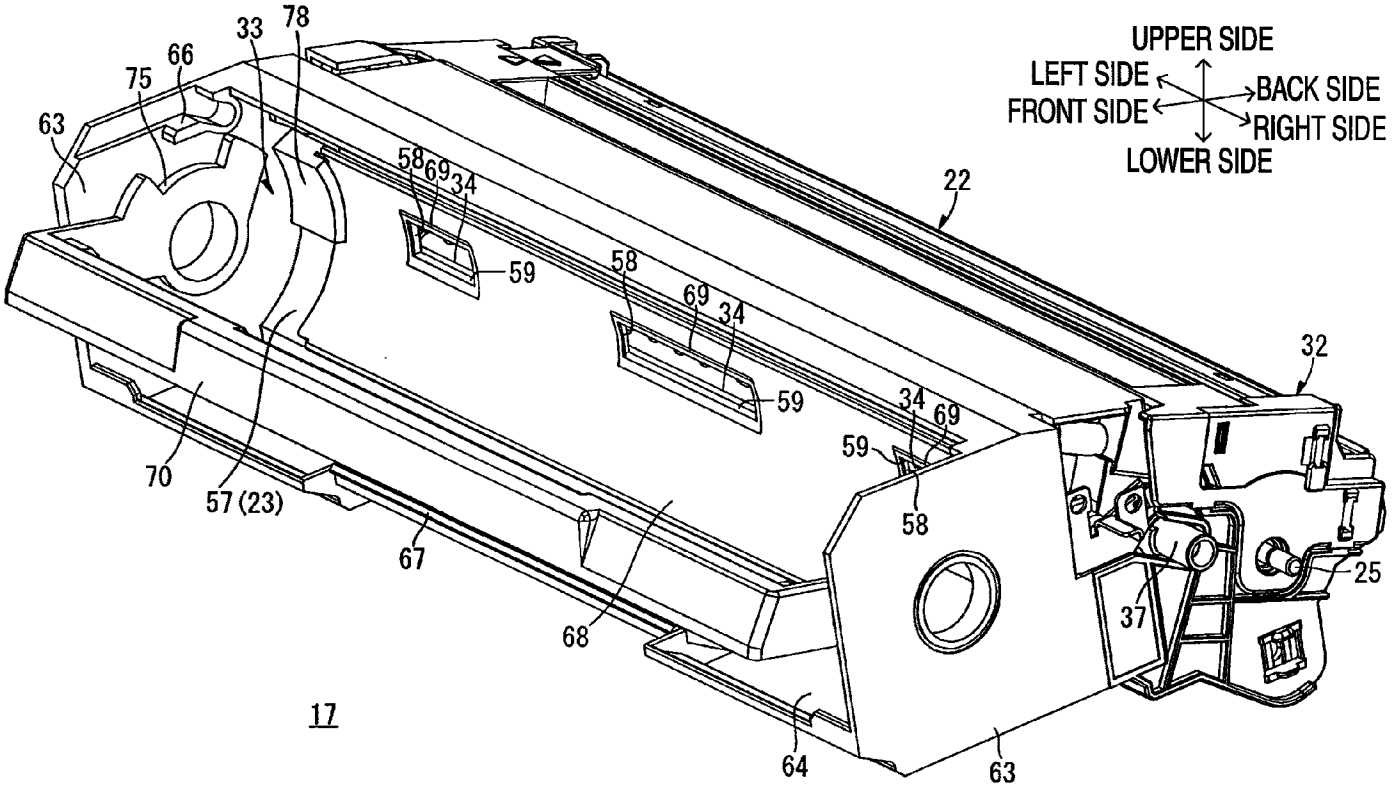
FIG. 6 is a perspective view in which the process cartridge is omitted from FIG. 4.

FIG. 3A is a left side sectional view of the process cartridge, showing a state where a developer cartridge is detached and the swing arm is located at a press releasing position, and FIG. 3B is a partial enlarged view of FIG. 3A. FIG. 4 is a perspective view of the process cartridge shown in FIG. 2A and 2B as obliquely viewed from the front left side. FIG. 5 is an exploded perspective view of the process cartridge as obliquely viewed from the front right side. FIG. 6 is a perspective view in which the process cartridge is omitted from FIG. 4.

(1) Partition Wall

As shown in FIGS. 2A and 2B, a curved portion 57 is formed in the middle in the vertical direction of the partition wall 23. The front side surface of the curved portion 57 is smoothly depressed backward along the outer circumferential surface of the developer cartridge 31. The frame-side passage hole 34 is formed in the curved portion 57. As shown in FIG. 6, three frame-side passage holes 34 are formed with a gap in the width direction. The frame-side passage holes 34 have substantially rectangular shapes longitudinal in the width direction and face the cartridge housing part 33.

As shown in FIGS. 2A and 2B, a frame seal 58 for preventing the leakage of the developer from the frame-side passage hole 34 is bonded to the front side surface of the curved portion 57.

The frame seal 58 is made of an elastic material such as sponge and rubber and has a band shape extending in the width direction. The frame seal 58 is bonded to the front side surface of the curved portion 57 so as to overlap with the frame-side passage holes 34 and three cutout portions 59 are formed with a gap in the width direction to correspond to the frame-side passage holes 34.

The front side surface of the curved portion 57 is provided with a shutter 68 for opening and closing the frame-side passage hole 34, as shown in FIGS. 3 and 5.

The shutter 68 has a substantially rectangular plate shape extending in the width direction and has a curved shape having substantially the same curvature as the curved portion 57. Three shutter openings 69 are formed in the shutter 68 to oppositely correspond to the frame-side passage holes 34 with a gap in the width direction.

The shutter 68 is disposed to interpose the frame seal 58 between the shutter and the front side surface of the curved portion 57. Both end portions in the width direction of the front side surface of the curved portion 57 are provided with shutter guide portions 78. The shutter 68 is supported so as to be slidable in the vertical direction in the shutter guide portions 78.

Accordingly, the shutter 68 is supported to freely swing in the vertical direction between an opened position (see FIGS. 2A and 2B) where the frame-side passage holes 34 are opened and a closed position (see FIGS. 3A and 5) where the frame-side passage holes 34 are closed above the opened position along the shutter guide portions 78.

(2) Cartridge Housing Part

The cartridge housing part 33 monolithically includes both side plates 63 opposed to each other with a gap in the width direction and a bottom plate 64 connecting the lower ends of both side plates 63 as shown in FIG. 5.

The inside surfaces in the width direction of both side plates 63 are provided with an upper locking portion 66 and a lower locking portion 67 is formed at the center in the width direction in the upper surface of the front end portion of the bottom plate 64 (see FIG. 3A).

A swing arm 70 is rotatably disposed in both side plates 63. The swing arm 70 has a substantially U shape in a plan view and has a receiving concave portion 75 formed at both end portions in the width direction.

The swing arm 70 swings between a press releasing position (see FIGS. 3 and 5) where the lower end come in contact with the front end of the bottom plate 64 and a pressing position (see FIGS. 2, 4, and 6) where the developer cartridge 31 is pressed from the front side at the time of housing the developer cartridge 31 in the cartridge housing part 33.

(Developer Cartridge)

Figure 7A:
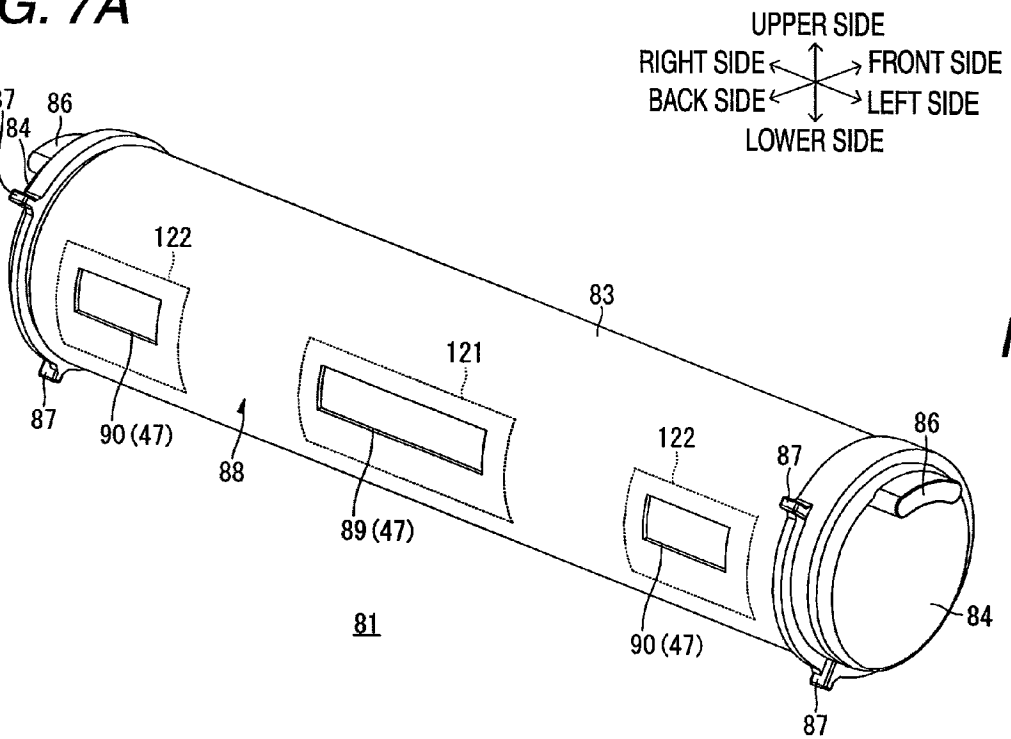
FIG. 7A is a perspective view showing an inside housing of the developer cartridge of the process cartridge of FIG. 2A according to a first exemplary embodiment of the invention as obliquely viewed from the back left side, showing a state before a supply-side seal and a return-side seal are attached.
Figure 7B:
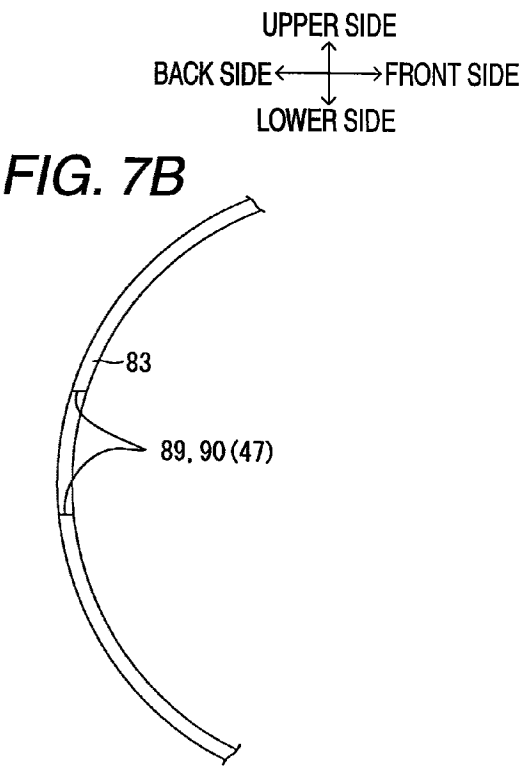
FIG. 7B is a partially side sectional view of an inside supply opening and an inside return opening of the inside housing shown in FIG. 7A.
Figure 8B:
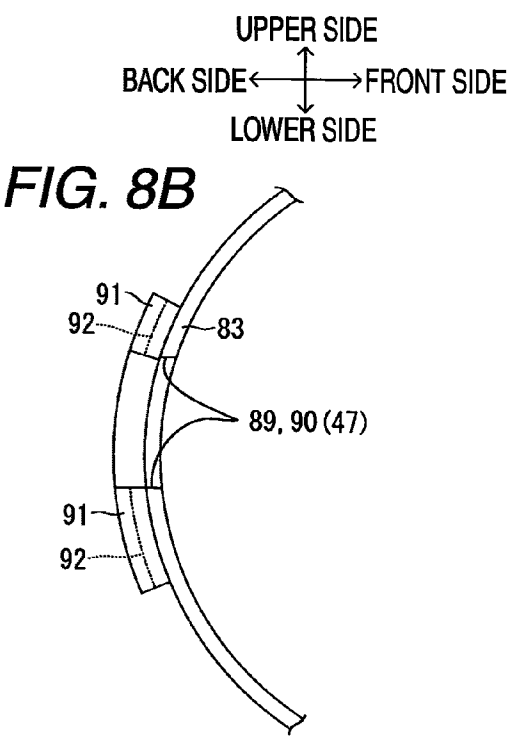
FIG. 8B is a partially side sectional view of the inside supply opening and the inside return opening of the inside housing shown in FIG. 8A.
Figure 8A:
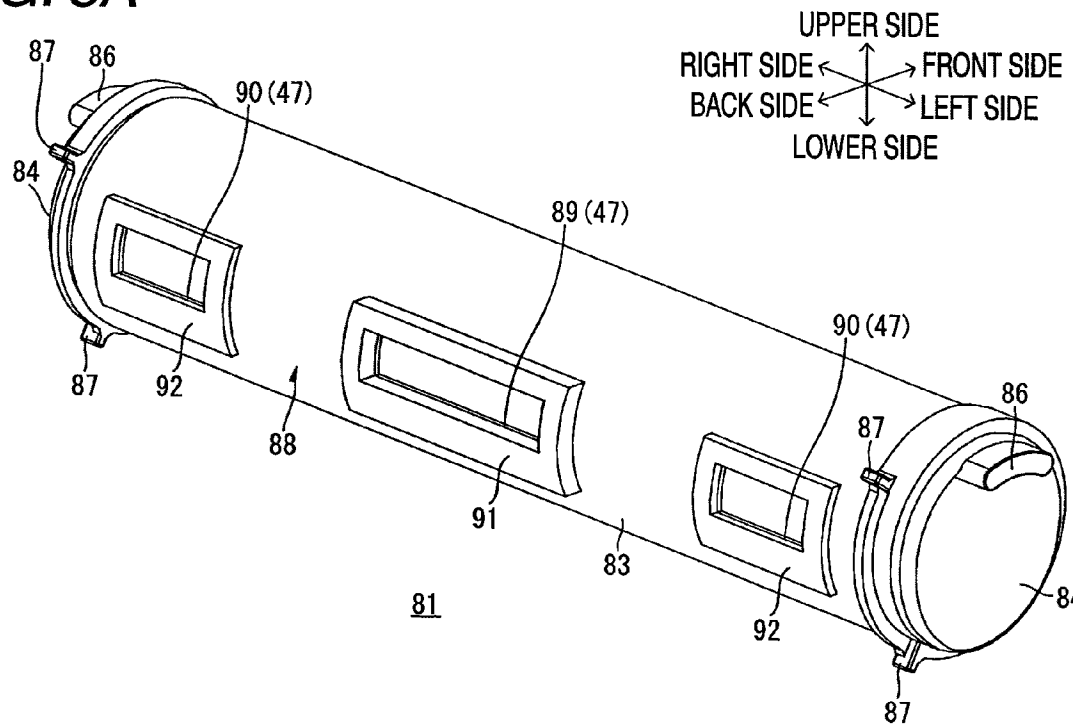
FIG. 8A is a perspective view of the inside housing of the developer cartridge of FIG. 7A as obliquely viewed from the back left side, showing a state after the supply-side seal and the return-side seal are attached.
Figure 9A:
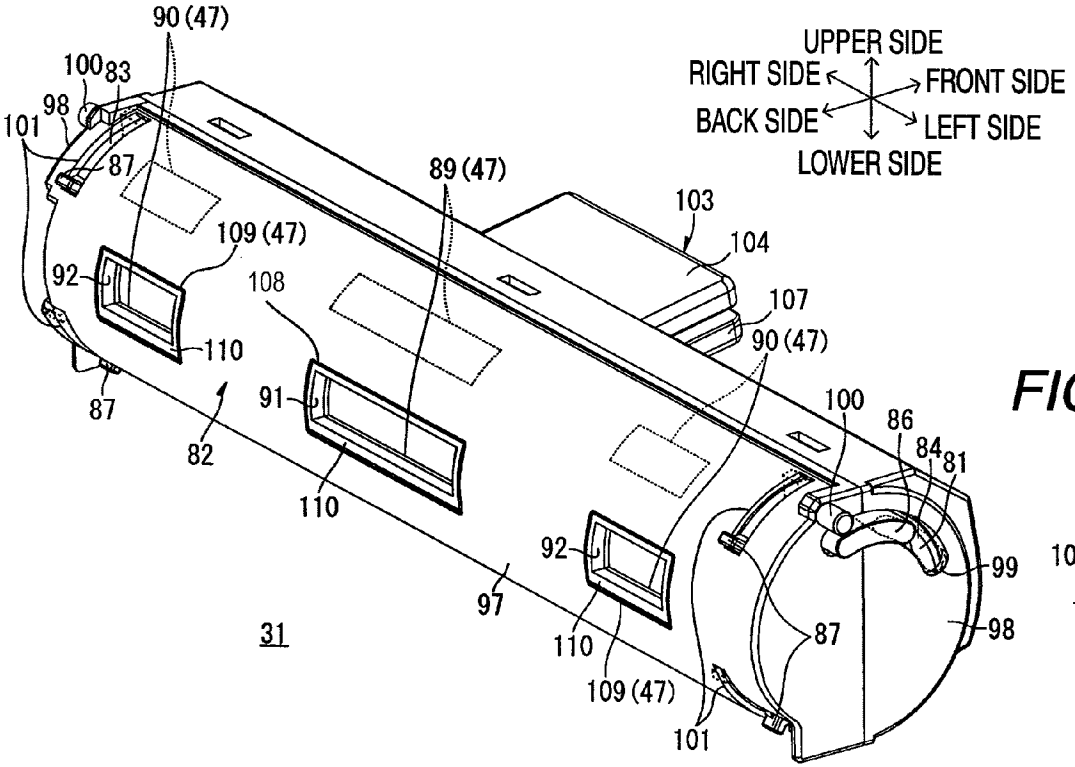
FIG. 9A is a perspective view of the developer cartridge of FIG. 8A as obliquely viewed from the back left side, showing a state where the inside housing is located at an opened position.
Figure 9B:
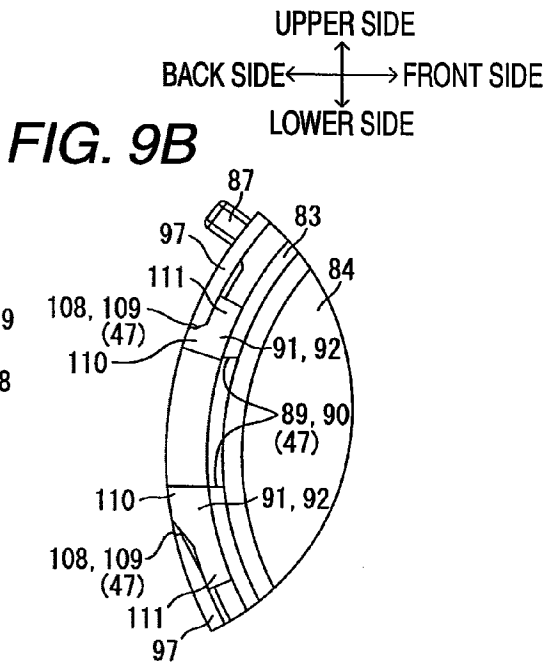
FIG. 9B is a partial side sectional view of a cartridge-side passing opening of the developer cartridge shown in FIG. 9A.

FIG. 7A is a perspective view showing an inside housing of a developer cartridge, according to a first exemplary embodiment of the present invention, as obliquely viewed from the back left side, showing a state before a supply-side seal and a return-side seal are attached. FIG. 7B is a partially side sectional view of an inside supply opening and an inside return opening of the inside housing shown in FIG. 7A. FIG. 8A is a perspective view of an inside housing of the developer cartridge of FIG. 7A as obliquely viewed from the back left side, showing a state after the supply-side seal and the return-side seal are attached. FIG. 8B is a partially side sectional view of the inside supply opening and the inside return opening of the inside housing shown in FIG. 8A. FIG. 9A is a perspective view of the developer cartridge of FIG. 8A as obliquely viewed from the back left side, showing a state where the inside housing is located at an opened position. FIG. 9B is a partial side sectional view of a cartridge-side passing opening of the developer cartridge shown in FIG. 9A.

As shown in FIGS. 7A to 9B, the developer cartridge 31 includes an inside housing 81 as an example of a first frame accommodating the developer and an outside housing 82 as an example of a second frame disposed outside the inside housing 81 to house the inside housing 81.

(1) Inside Housing

The inside housing 81 has an inner space partitioned as a developer chamber accommodating the developer and monolithically includes a cylindrical inside circumferential wall 83 extending in the width direction and a pair of cylindrical inside walls 84 closing both end portions in the width direction of the inside circumferential wall 83, as shown in FIG. 7A.

A slide protrusion 86 is disposed at one position (upper end portion in FIG. 7A) on the circumferential edge of the inside wall 84. The slide protrusion 86 has a circular arc shape along the outer circumferential surface of the inside wall 84 in a side view and protrudes outward in the width direction from the inside wall 84.

A pair of interposing protrusions 87 protruding in the diameter direction from the circumferential end surface is disposed in the backside portion of the inside wall 84. The pair of interposing protrusions 87 is disposed in the circumferential end surface of the inside wall 84 with a gap in the circumferential direction (a gap corresponding to the circumferential length of the shutter 68).

In the inside circumferential wall 83, the inside supply opening 89 and the inside return opening 90 are formed in an upper portion of a surrounding portion 88 as a wall surface surrounded with the pair of interposing protrusions 87 (four interposing protrusions 87) disposed at both ends in the width direction. The inside supply opening 89 and the inside return opening 90 correspond to the cartridge-side passage holes 47.

The inside supply opening 89 and the inside return opening 90 have substantially rectangular shapes extending in the width direction in a rear view and are disposed with a gap in the width direction. The inside supply opening 89 is opened at the center in the width direction of the surrounding portion 88 and the inside return opening 90 is opened at both ends in the width direction of the surrounding portion 88 with the inside supply opening 89 interposed therebetween.

When the inside housing 81 is located at the opened position, the inside supply opening 89 is opposed to an outside supply opening 108 (to be described later). The inside return openings 90 are opposed to outside return openings 109 (to be described later) (see FIGS. 9A and 9B).

(2) Supply-Side Seal and Return-Side Seal

As shown in FIGS. 8A and 8B, the inside housing 81 is provided with a supply-side seal 91 as an example of a second sealing member around the inside supply opening 89 in the surrounding portion 88 and a return-side seal 92 as an example of a first sealing member around each of the inside return openings 90.

That is, as indicated by a dotted line of FIG. 7A, in the surrounding portion 88, a supply-side bonding surface 121 as an example of a second bonding surface for bonding the supply-side seal 91 is defined around the inside supply opening 89. The supply-side bonding surface 121 is defined in a rectangular frame shape surrounding the inside supply opening 89 and extends downward slightly more in the longitudinal direction in the rear view and is continuous from the surrounding portion 88 around the supply-side bonding surface 121 without any unevenness.

As shown in FIG. 8A, the supply-side seal 91 is bonded to the supply-side bonding surface 121. That is, the supply-side seal 91 has a rectangular frame shape surrounding the inside supply opening 89 and extends downward slightly more in the longitudinal direction. The supply-side seal 91 is made of an elastic material such as sponge and rubber and has the same rectangular frame shape surrounding the inside supply opening 89 as the supply-side bonding surface 121 in the rear view.

The supply-side seal 91 is formed uniform in the thickness direction (in the same direction as the opposing direction of the inside housing 81 and the outside housing 82 when the inside housing 81 is located at the closed position). The thickness thereof is greater than that of the return-side seal 92. Specifically, when the thickness of the return-side seal 92 is 100%, the thickness of the supply-side seal 91 is in the range of 110% to 150%. For example, the thickness of the supply-side seal 91 may be set in the range of about 3.3 to about 4.5 mm.

That is, as indicated by a dotted line of FIG. 7A, in the surrounding portion 88, a return-side bonding surface 122 as an example of a first bonding surface for bonding the return-side seal 92 is defined around the inside return opening 90. The return-side bonding surfaces 122 are defined in a rectangular frame shape surrounding the inside return openings 90, respectively, and extending downward slightly more in the longitudinal direction in the rear view and being continuous from the surrounding portion 88 around the return-side bonding surface 122 without any unevenness.

The return-side seal 92 is bonded to the return-side bonding surface 122. That is, the return-side seals 92 have a rectangular frame shape surrounding the inside return openings 90, respectively, and extend downward slightly more in the longitudinal direction. The return-side seal 92 is made of an elastic material such as sponge or rubber and has the same rectangular frame shape surrounding the inside return openings 90 as the return-side bonding surface 122 in the rear view.

The return-side seal 92 is formed uniform in the thickness direction and the thickness thereof is set, for example, in the range of about 2.0 to about 4.0 mm. The supply-side seal 91 and the return-side seal 92 are formed of the same material using the same manufacturing method and are different from each other only in thickness.

(3) Agitator

Figure 10A:
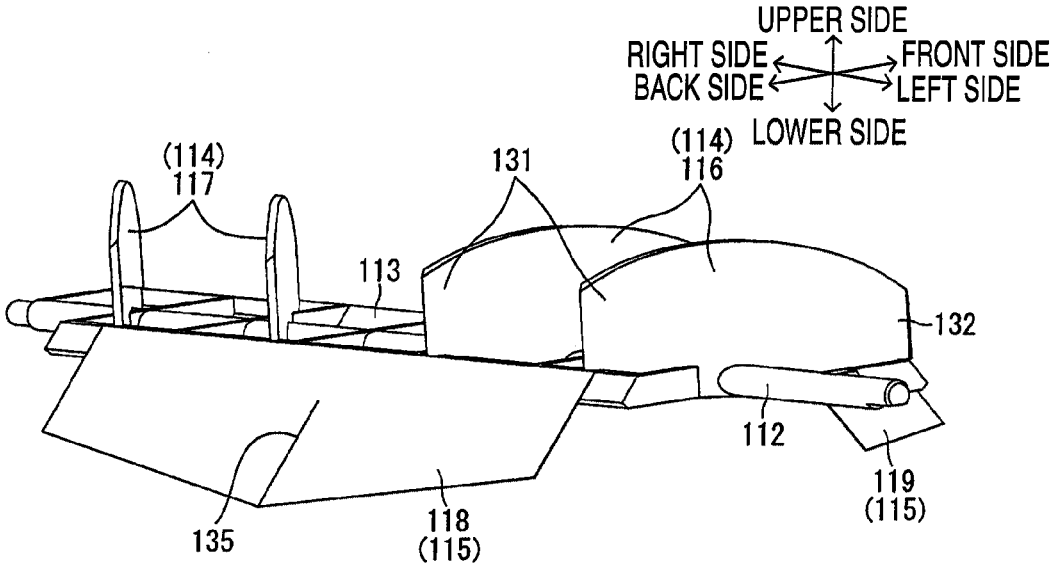
FIG. 10A is a perspective view of an agitator at a rotation angle at which a central blade is opposed to a supply opening as obliquely viewed from the back left side.
Figure 10B:
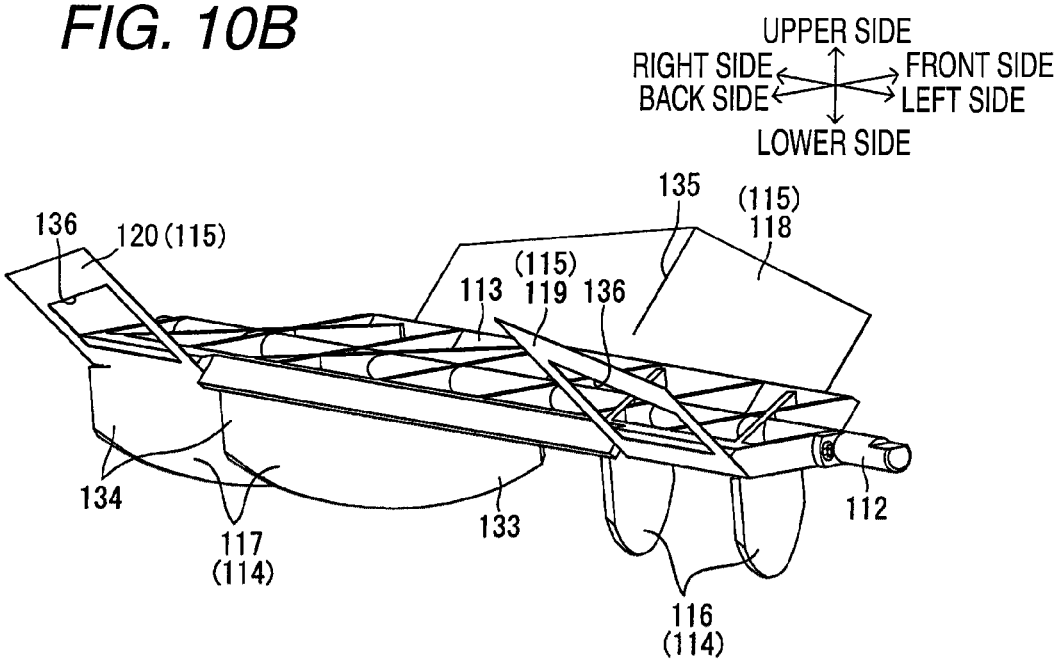
FIG. 10B is a perspective view of the agitator at a rotation angle at which the central blade is located opposite to the supply opening as obliquely viewed from the back left side.
Figure 11:
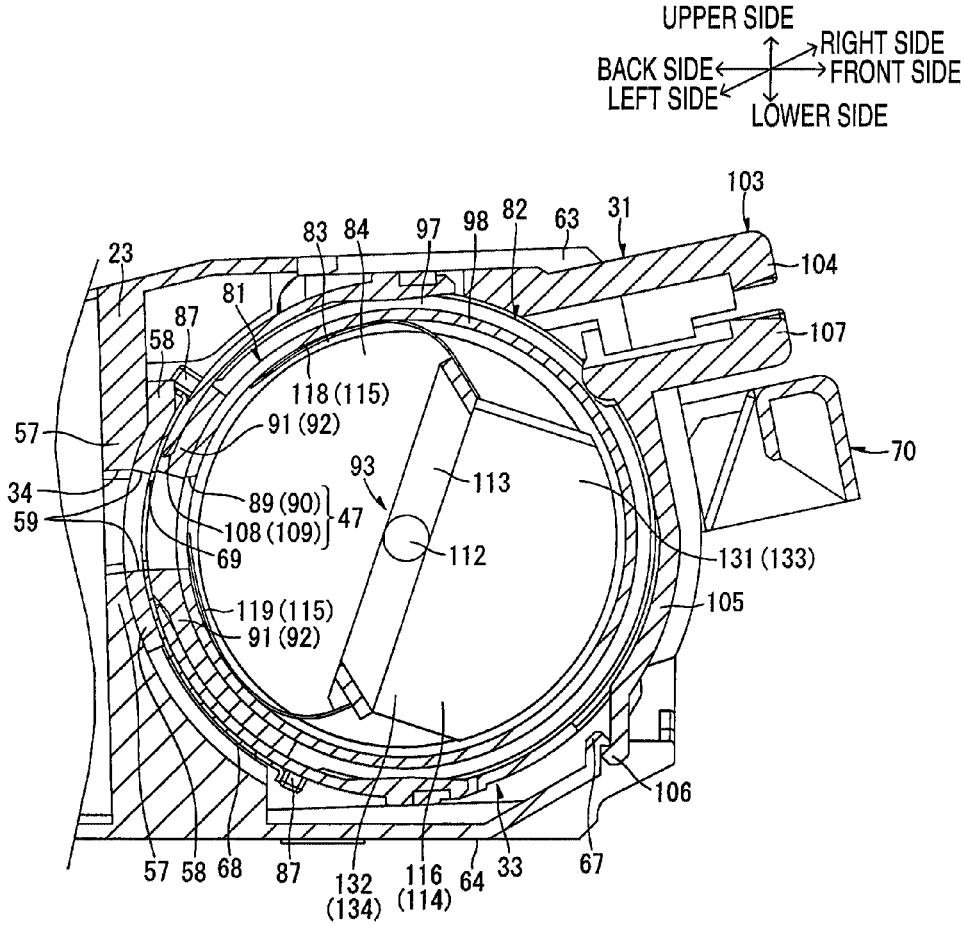
FIG. 11 is a partial side sectional view of the developer cartridge of FIG. 9A.

FIG. 10A is a perspective view of an agitator at a rotation angle at which a central blade is opposed to a supply opening as obliquely viewed from the back left side. FIG. 10B is a perspective view of the agitator at a rotation angle at which the central blade is opposed to the supply opening as obliquely viewed from the back left side. FIG. 11 is a partial side sectional view of the developer cartridge.

The agitator 93 is disposed in the inside housing 81.

As shown in FIGS. 10A and 10B, the agitator 93 includes a rotation shaft 112, a frame plate 113, a tilt agitation plate 114, and an agitation blade 115.

The rotation shaft 112 is disposed at the center of the inside housing 81 in the rear view, extends in the width direction (the direction in which the inside supply opening 89 and the inside return openings 90 are arranged), and is rotatably supported by both inside walls 84.

The frame plate 113 has a lattice shape and is disposed in the rotation shaft 112 in the axis direction so as to extend only in the diameter direction across the rotation shaft 112.

The tilt agitation plate 114 includes a left agitation plate 116 and a right agitation plate 117.

A plurality of left agitation plates (e.g., two left agitation plates) 116 are disposed on the left side about the center in the axis direction of the rotation shaft 112 with a gap in the axis direction. The left agitation plates 116 are disposed in the frame plate 113 so that a downstream end portion 131 in the rotation direction of the rotation shaft 112 is located closer to the center in the axis direction (that is, closer to the inside supply opening 89) than an upstream end portion 132, the downstream end portion 131 faces the right side, the upstream end portion 132 faces the left side, and the left agitation plates are tilted about the rotation shaft and the axis direction of the rotation shaft 112.

A plurality of right agitation plates (e.g., two right agitation plates) 117 are disposed on the right side about the center in the axis direction of the rotation shaft 112 with a gap in the axis direction. The right agitation plates 117 are disposed in the frame plate 113 so that a downstream end portion 133 in the rotation direction of the rotation shaft 112 is located closer to the center in the axis direction (that is, closer to the inside supply opening 89) than an upstream end portion 134, the downstream end portion 133 faces the left side, the upstream end portion 134 faces the right side, and the right agitation plates are tilted about the rotation shaft and the axis direction of the rotation shaft 112.

The agitation blade 115 is made of a flexible film of polyethylene terephthalate and includes a center blade 118 and both end blades 119 and 120.

The center blade 118 has a rectangular shape and is disposed at the center in the axis direction of the rotation shaft 112 so as to be opposed to the inside supply opening 89 at the time of rotation. The center blade 118 protrudes from an end portion in the diameter direction of the frame plate 113 to the downstream in the rotation direction of the rotation shaft 112 so as to frictionally slide on the inner circumferential surface of the inside housing 81. Accordingly, the center blade 118 is bent to the downstream side in the rotation direction along the inner circumferential surface of the inside housing 81 (see FIG. 11). A cut-in 135 is formed in the free end portion of the center blade 118 toward a base end portion (toward the frame plate 113) from the vertex at the center in the width direction. The cut-in 135 is formed in the middle from the vertex to the base end portion.

Both end blades 119 and 120 have substantially rectangular frame shapes having a rectangular opening 136 and is disposed at both ends in the axis direction of the rotation shaft 112 so as to be opposed to the inside return openings 90 at the time of rotation. Both end blades 119 and 120 protrude from the other end portion in the diameter direction of the frame plate 113 to the upstream in the rotation direction of the rotation shaft 112 so as to form substantially a diamond shape.

In other words, the ends of both end blades 119 and 120 have a width greater than that of the inside return openings 90 in the direction parallel to the rotation shaft 112 and are formed oblique about the end of the front portion of the inside return openings 90 in the rotation direction of the rotation shaft 112. In both end blades 119 and 120, the free ends frictionally sliding on the inner circumferential surface of the inside housing 81. According to this configuration, the inflow of the developer returned from the inside return openings 90 by both end blades 119 and 120 is not hindered.

(4) Outside Housing

The outside housing 82 is slightly greater in the width direction and the diameter direction than the inside housing 81 so as to rotatably house the inside housing 81.

As shown in FIG. 9A, the outside housing 82 monolithically includes a substantially cylindrical outside circumferential wall 97 extending in the width direction and a pair of outside walls 98 closing both end portions in the width direction of the outside circumferential wall 97 and having substantially a disk shape.

The outer circumferential surfaces of the upper portion and the front upper portion of the outside circumferential wall 97 have a flat shape, but the inner circumferential surface of the outside circumferential surface 97 has a circular section (see FIGS. 2A and 2B).

Slide holes 99 into which the slide protrusions 86 are inserted are formed in the upper portions of the outside walls 98. The slide holes 99 are disposed to face the slide protrusions 86 in the width direction. The slide holes 99 have a circular arc shape longer than the slide protrusions 86 in the side view.

The upper end portions of the outside walls 98 are provided with a boss 100 protruding outward in the width direction.

Four longitudinal holes 101 into which protrusions 87 (e.g., four protrusions 87) are inserted are formed in both end portions in the width direction of the outside circumferential wall 97. The longitudinal holes 101 are disposed to face the protrusions 87 in the diameter direction. The longitudinal holes 101 has a substantially rectangular shape vertically extending in the rear view and have a length corresponding to a swing range between the opened position and the closed position of the shutter 68.

In the outer circumferential wall 97, an outside supply opening 108 and outside return openings 109 are formed between four longitudinal holes 101 (i.e., between two upper longitudinal holes 101 and two lower longitudinal holes 101). The outside supply opening 108 and the outside return openings 109 correspond to the cartridge-side passage holes 47.

The outside supply opening 108 and the outside return openings 109 have a substantially rectangular shape extending in the width direction in the rear view and are disposed with a gap in the width direction therebetween. The outside supply opening 108 is opened at the center in the width direction of the outside circumferential wall 97 and the outside return openings 109 are opened at both ends in the width direction of the outside circumferential wall 97 with the outside supply opening 108 interposed therebetween. The outside supply opening 108 has a shape similar to and slightly larger than the inside supply opening 89 and the outside return openings 109 have a shape similar to and slightly larger than the inside return openings 90.

When the developer cartridge 31 is attached to the cartridge housing part 33, the outside supply opening 108 is opposed to the frame-side passage hole 34 (see FIG. 6) at the center in the width direction and the cut portion 59 (see FIG. 6) of the shutter 68. The outside return openings 109 are opposed to the frame-side passage holes 34 (see FIG. 6) at both ends in the width direction and the cut portions 59 of the shutter 68 (see FIG. 6).

A grasp portion 103 is disposed in front of the outside circumferential wall 97. As shown in FIG. 2A, the grasp portion 103 includes an upper grasp plate 104 protruding forward from the upper end portion of the outside circumferential wall 97 and a locking arm 105 having substantially a J shape extending downward in the side view below the upper grasp plate 104.

The upper end portion of the locking arm 105 is pivotally supported by a supporting pivot (not shown) disposed below the upper grasp plate 104. A locking claw 106 locked to a lower locking portion 67 is disposed in the lower end portion of the locking arm 105.

A lower grasp plate 107 protruding forward is monolithically disposed in the vicinity of the upper end portion of the locking arm 105. The lower grasp plate 107 is disposed in parallel with the upper grasp plate 104 with a gap therebetween and a compression spring (not shown) urging the plates apart from each other is interposed between the upper grasp plate 104 and the lower grasp plate 107.

(5) Relative Arrangement of Inside Housing and Outside Housing

The inside housing 81 is rotatably housed in the outside housing 82.

Specifically, the outer circumferential surface of the inside circumferential wall 83 is disposed to be slidable relative to the inner circumferential surface of the outside circumferential wall 97 in the circumferential direction. More specifically, the supply-side seal 91 and the return-side seal 92 are disposed between the inner circumferential surface of the outside circumferential wall 97 and the outer circumferential surface of the inside circumferential wall 83, are bonded to the supply-side bonding surface 121 and the return-side bonding surfaces 122 of the inside circumferential wall 83, and are in contact with the inner circumferential surface of the outside circumferential wall 97 so as to be slidable.

As shown in FIG. 9A, the slide protrusions 86 are inserted into the slide holes 99. The protrusions 87 are inserted into the longitudinal holes 101 and the protrusions 87 protrude outward in the diameter direction from the longitudinal holes 101.

The inside housing 81 is allowed to rotate relative to the outside housing 82 between the closed position (see FIG. 5) where the inside supply opening 89 and the inside return openings 90 are not opposed to the outside supply opening 108 and the outside return openings 109, respectively, and the opened position (see FIG. 9) where the inside supply opening 89 and the inside return openings 90 are opposed to the outside supply opening 108 and the outside return openings 109, respectively.

When the inside housing 81 is located at the closed position, as indicated by the dotted lines in FIGS. 5 and 9A, the slide protrusions 86 are disposed in the front end portions of the slide holes 99, respectively, and the protrusions 87 are disposed in the upper end portions of the longitudinal holes 101, respectively. As indicated by the dotted lines in FIG. 9A, the inside supply opening 89 and the inside return openings 90 are disposed above the outside supply opening 108 and the outside return openings 109, respectively, and the outside supply opening 108 and the outside return openings 109 are closed by a portion below the inside supply opening 89 and the inside return openings 90 (portion indicated by the dotted line), respectively, of the inside circumferential wall 83 (surrounding portion 88).

When the inside housing 81 is located at the closed position, the supply-side seal 91 and the return-side seal 92 are compressed, which is not shown in the drawings, between the inside circumferential wall 83 and the outside circumferential wall 97 (see FIG. 9B). At this time, since a constant gap in the width direction is interposed between the inside circumferential wall 83 and the outside circumferential wall 97 and the thickness of the supply-side seal 91 is greater than that of the return-side seal 92, the supply-side seal 91 is more compressed than the return-side seal 92 and comes in pressing contact with the inside circumferential wall 83 and the outside circumferential wall 97 with the repulsive force, where a contact pressure (which is an example of a second contact pressure and referred to as a supply-side contact pressure) of the supply-side seal 91 is greater than a contact pressure (which is an example of a first contact pressure and referred to as a return-side contact pressure) of the return-side seal 92.

When the inside housing 81 is made to rotate relative to the outside housing 82 in a direction (downward) in which the inside supply opening 89 and the inside return openings 90 get close to the outside supply opening 108 and the outside return openings 109, respectively, and the inside supply opening 89 and the inside return openings 90 are opposed to the outside supply opening 108 and the outside return openings 109, respectively, the inside housing 81 is located at the opened position as shown in FIG. 9A.

When the inside housing 81 is located at the opened position, the slide protrusions 86 are located in the rear end portion of the slide holes 99 and the protrusions 87 are located in the lower end portions of the longitudinal holes 101. The inside supply opening 89 communicates with the outside supply opening 108 and the inside return openings 90 communicate with the outside return openings 109.

When the inside housing 81 is located at the opened position, the inner end portions 110 of the supply-side seal 91 and the return-side seals 92 are exposed from the outside supply opening 108 and the outside return openings 109, respectively, and protrude so as to be substantially flush with the outer circumferential surface of the outside circumferential wall 97, as shown in FIG. 9B.

The outer end portions 111 of the supply-side seal 91 and the return-side seals 92 are pressed between the outside circumferential wall 97 and the inside circumferential wall 83 so as to surround the circumferential end portions of the outside supply opening 108 and the outside return openings 109. Accordingly, it is possible to prevent the leakage of the developer between the inside circumferential wall 83 and the outside circumferential wall 97.

At this time, as described above, the supply-side seal 91 comes in contact with the inside circumferential wall 83 and the outside circumferential wall 97 with the supply-side contact pressure greater than the return-side contact pressure.

(Attachment and Detachment of Developer Cartridge to and from Process Cartridge)

(1) Attachment of Developer Cartridge to Process Cartridge

When it is intended to attach the developer cartridge 31 to the process cartridge 22, as shown in FIG. 5, the upper grasp plate 104 and the lower grasp plate 107 are pressed together against the urging force of the compression spring (not shown). Then, the developer cartridge 31 (the developer cartridge 31 in which the inside housing 81 is located at the closed position) is attached to the cartridge housing part 33 (the cartridge housing part 33 in which the shutter 68 is located at the closed position and the swing arm 70 is located at the press releasing position)

Accordingly, the developer cartridge 31 is placed on the bottom plate 64. At this time, the bosses 100 are received in the upper locking portions 66 and the slide protrusions 86 are inserted into the receiving concave portions 75, as shown in FIG. 2A, whereby the protrusions 87 on both sides in the width direction are positioned at the upper end and the lower edges and the upper edges of both ends in the width direction of the shutter 68.

Thereafter, when the upper grasp plate 104 and the lower grasp plate 107 is released, the locking arm 105 swings with the urging force of the compression spring and the locking claws 106 are locked to the lower locking portions 67, whereby the developer cartridge 31 is housed in the cartridge housing part 33.

The outside housing 82 is fixed to the cartridge housing part 33, since the bosses 100 are received in the upper locking portions 66 and the locking claws 106 are locked to the lower locking portions 67.

Then, by allowing the swing arm 70 to swing from down to up, the swing arm is allowed to swing from the press releasing position to the pressing position. Accordingly, the slide protrusions 86 inserted into the receiving concave portions 75 (see FIG. 5) slide backward in the slide holes 99 with the swing of the swing arm 70 and are located in the rear end portions of the slide holes 99 (see FIG. 9A). In addition, the protrusions 87 on both sides in the width direction slide downward in the longitudinal holes 101 along with the shutter 68 and are located in the lower end portions of the longitudinal holes 101 (see FIG. 9A).

Accordingly, the inside housing 81 is located at the opened position and as shown in FIGS. 2A and 9A, the outside supply opening 108 and the outside return openings 109 are opened from the lower portion of the surrounding portion 88, whereby the inside supply opening 89 communicates with the outside supply opening 108 in the substantially horizontal direction and the inside return openings 90 communicate with the outside return openings 109 in the substantially horizontal direction.

The shutter 68 is located at the opened position and the frame-side passage hole 34 are opposed to the shutter opening 69 and the cartridge-side passage hole 47 (that is, the inside supply opening 89 and the outside supply openings 108 communicating with each other and the inside return openings 90 and the outside return openings 109 communicating with each other) in the substantially horizontal direction, whereby the openings communicate with each other.

At this time, as shown in FIG. 2B, the inner circumferential ends 110 of the supply-side seal 91 and the return-side seals 92 protrude backward to surround the shutter opening 69, press the frame seal 58 and the shutter 68 on the lower side, and press the shutter 68 on the upper side thereof. Accordingly, since the space between the frame-side passage hole 34 and the cartridge-side passage hole 47 is sealed by the frame seal 58, the supply-side seal 91, and the return-side seals 92 without any gap, it is possible to prevent the leakage of the developer therebetween.

At the time of forming an image, the agitator 93 is actuated and the rotation shaft 112 rotates. Then, since the left agitation plate 116 and the right agitation plate 117 also rotate with the rotation of the rotation shaft 112, the developer is transported from both end portions in the width direction to the center portion in the inside housing 81. That is, in the inside housing 81, the developer is transported to the inside supply opening 89 in the axis direction of the rotation shaft 112 by the left agitation plate 116 and the right agitation plate 117.

With the rotation of the rotation shaft 112, the agitation blade 115 rotates. Then, the center blade 118 is bent due to the cut-in 135 in the end portion and rotates while frictionally sliding on the inner circumferential surface of the inside housing 81 so as to pump up the developer. When the center blade is opposed to the inside supply opening 89, the bending facing downstream in the rotation direction of the rotation shaft 112 is released, the developer is pumped up to the inside supply opening 89, and the developer is strongly discharged. Then, as indicated by the bold arrow, the developer passes horizontally through the inside supply opening 89, the outside supply opening 108, the shutter opening 69 at the center in the width direction, and the frame-side passage hole 34 at the center in the width direction and then is supplied to the developing part 32.

In the developing part 32, the developer is transported to both ends in the width direction and is supplied to the supply roller 36 by the auger 39. In contrast, some developer passes substantially horizontally through the frame-side passage holes 34 on both sides in the width direction, the shutter openings 69 on both sides in the width direction, the outside return openings 109, and the inside return openings 90 and is retuned to the inside housing 81.

Here, the rectangular opening 136 is formed in both end blades 119 and 120 opposed to the inside return openings 90. Accordingly, even when both end blades 119 and 120 are opposed to the inside return openings 90, the developer can be smoothly returned from the rectangular openings 136 to the inside housing 81.

Accordingly, the developer circulates between the developing part 32 and the developer cartridge 31.

(2) Detachment of Developer Cartridge from Process Frame

When it is intended to detach the developer cartridge 31 from the process cartridge 22, first, the swing arm 70 is made to swing from up to down and thus from the pressing position to the press releasing position (see FIG. 3A).

Then, as shown in FIG. 5, the slide protrusions 86 inserted into the receiving concave portions 75 slide forward in the slide holes 99 with the swing of the swing arm 70 and are located in the front end portions of the slide holes 99. Then, as shown in FIGS. 2A and 2B, the protrusions 87 on both sides in the width direction slide upward in the longitudinal holes 101 with the shutter 68 interposed therebetween and are located in the upper end portions of the longitudinal holes 101 (see the dotted line in FIG. 9).

Accordingly, the inside housing 81 is located at the closed position and the lower portion of the surrounding portion 88 is opposed to the outside supply opening 108 and the outside return openings 109, thereby closing the openings. The shutter 68 is located at the closed position and the frame-side passage hole 34 is opposed to the shutter 68 and is finally closed (see FIG. 3).

When the upper grasp plate 104 and the lower grasp plate 107 shown in FIG. 2A are pressed together, the locking of the locking claws 106 to the lower locking portions 67 is released. Accordingly, as shown in FIG. 5, when the developer cartridge 31 is drawn forward from the cartridge housing part 33, the developer cartridge 31 is detached from the process frame 22.

As described above, in the process cartridge 17, the developer is supplied from the inside housing 81 to the developing part 32 through the inside supply opening 89, the outside supply opening 108, the shutter opening 69 at the center in the width direction, and the frame-side passage hole 34 at the center in the width direction. In contrast, the developer from the developing part 32 to the inside housing 81 through the frame-side passage holes 34 at both ends in the width direction, the shutter openings 69 at both ends in the width direction, the outside return openings 109, and the inside return openings 90. Accordingly, it is possible to secure the circulation of the developer between the developing part 32 and the developer cartridge 31.

When the inside housing 81 is located at the opened position, the outer circumferential end 111 of the supply-side seal 91 is pressed against the inside circumferential wall 83 and the outside circumferential wall 97 with the supply-side contact pressure greater than the return-side contact pressure. Accordingly, even when the developer being passing through the inside supply opening 89 and the outside supply opening 108 is attached to the upper supply-side seal 91 with the pumping of the agitator 93 at the time of supplying the developer from the inside supply opening 89 and the outside supply opening 108 to the developing part 32 with the agitation of the agitator 93, it is possible to prevent the developer from leaking between the inside housing 81 and the outside housing 82.

In contrast, the return-side contact pressure of the return-side seal 92 is smaller than the supply-side contact pressure of the supply-side seal 91, it is possible to reduce the sliding resistance between the inside housing 81 and the outside housing 82, compared with a case where the return-side contact pressure and the supply-side contact pressure are both enhanced. Accordingly, it is possible to secure the easy relative rotation of the inside housing 81 and the outside housing 82, thereby improving the operability.

The supply-side seal 91 has a thickness greater than that of the return-side seal 92. Accordingly, the supply-side contact pressure of the supply-side seal 91 can be simply and reliably made to be greater than the return-side contact pressure of the return-side seal 92.

When the rotation shaft 112 rotates, the left agitation plate 116 and the right agitation plate 117 transport the developer to the inside supply opening 89 in the axis direction of the rotation shaft 112 and the center blade 118 supplies the developer from the inside supply opening 89 to the developing part 32 in the rotation direction of the rotation shaft 112. The center blade 118 is bent to the downstream in the rotation direction along the inside surface of the inside housing 81. Accordingly, when the developer is supplied from the inside supply opening 89 to the developing part 32, the bending is released and the developer is pumped up to the inside supply opening 89, whereby the developer is strongly supplied to the developing part 32. Therefore, it is possible to reliably supply the developer from the inside supply opening 89 to the developing part 32.

In contrast, as described above, when the developer is pumped up to the inside supply opening 89 by the center blade 118, the developer can be easily attached to the supply-side seal 91.

However, the supply-side contact pressure of the supply-side seal 91 is greater than the return-side contact pressure of the return-side seal 92. Accordingly, for example, when the developer is attached to the supply-side seal 91, it is possible to prevent the developer from leaking between the inside housing 81 and the outside housing 82.

In the process cartridge 17 and the image forming apparatus 1, it is possible to secure the circulation of the developer and to prevent the leakage of the developer.

II. Second Exemplary Embodiment

Figures 12A, 12B:
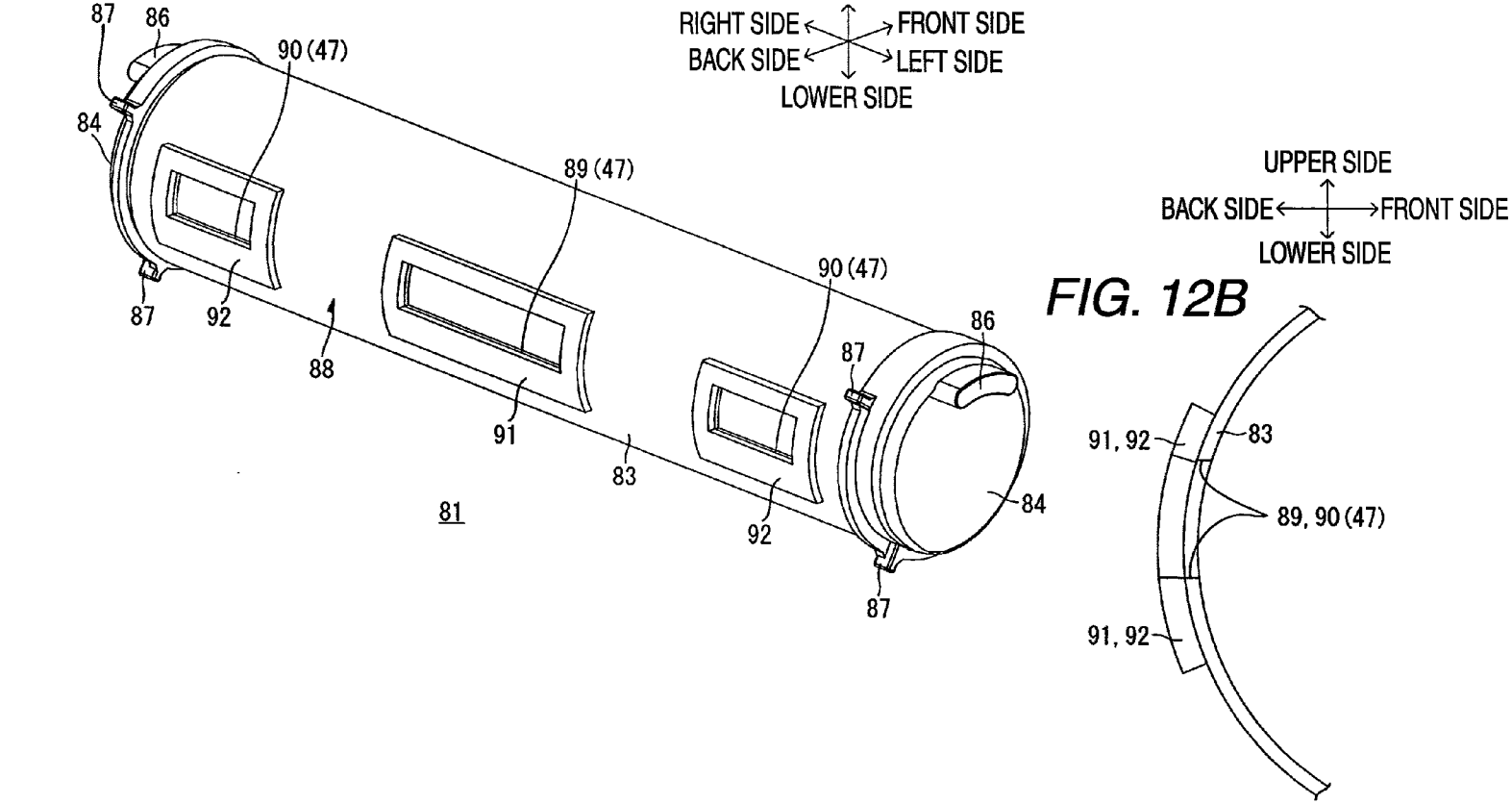
FIGS. 12A and 12B are a perspective view and a partial side sectional view, respectively, of a developer cartridge according to a second exemplary embodiment of the invention.

FIGS. 12A and 12B are a perspective view and a partial side sectional view of a developer cartridge according to the second exemplary embodiment of the invention. The views in FIGS. 12A and 12B correspond to the views in FIGS. 8A and 8B. In FIGS. 12A, 12B, elements corresponding to those of FIGS. 8A, 8B are denoted by the same reference numerals and description thereof is omitted.

In the first exemplary embodiment, by setting the thickness of the supply-side seal 91 to be greater than that of the return-side seal 92, the supply-side contact pressure of the supply-side seal 91 is set to be greater than the return-side contact pressure of the return-side seal 92.

In a second exemplary embodiment, as shown in FIGS. 12A and 12B, the thickness of the supply-side seal 91 is set to be equal to that of the return-side seal 92 and the supply-side seal 91 is formed of sponge or rubber that is harder than the sponge or rubber of the return-side seal 92, whereby the hardness of the supply-side seal 91 is greater than that of the return-side seal 92.

Since the hardness of the supply-side seal 91 is greater than that of the return-side seal 92, the repulsive force of the supply-side seal 91 is greater than that of the return-side seal 92 and thus the supply-side contact pressure is greater than the return-side contact pressure, at the time of compressing the outer circumferential ends 111 of the supply-side seal 91 and the return-side seal 92 between the inside circumferential wall 83 and the outside circumferential wall 97.

In this case, the supply-side contact pressure of the supply-side seal 91 can be simply and reliably made to be greater than the return-side contact pressure of the return-side seal 92.

The hardness of the supply-side seal 91 and the return-side seal 92 can be properly selected. Specifically, the hardness of the supply-side seal 91 may be set to the range of about 0.01 to about 0.03 MPa under the 25% compression load defined in JIS K 6254 and the hardness of the return-side seal 92 may be set to the range of about 0.006 to about 0.009 MPa under the 25% compression load defined in JIS K 6254.

Alternatively, the thickness of the supply-side seal 91 can be set to be greater than that of the return-side seal 92 and the hardness of the supply-side seal 91 can be set to be greater than that of the return-side seal 92.

III. Third Exemplary Embodiment

Figures 13A, 13B:
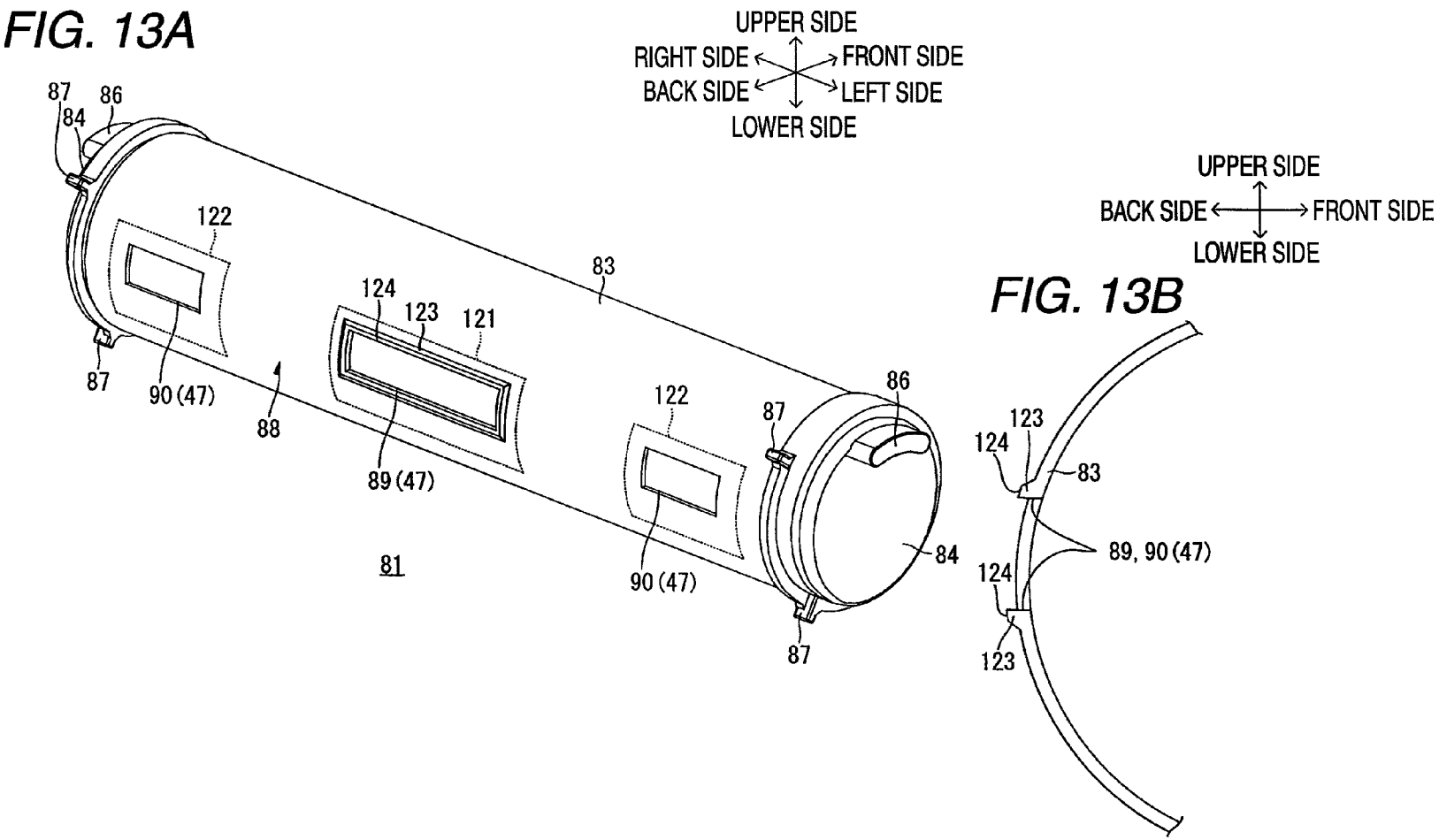
FIGS. 13A and 13B are a perspective view and a partial side sectional view of a developer cartridge according to a third exemplary embodiment of the invention.
Figures 14A, 14B:
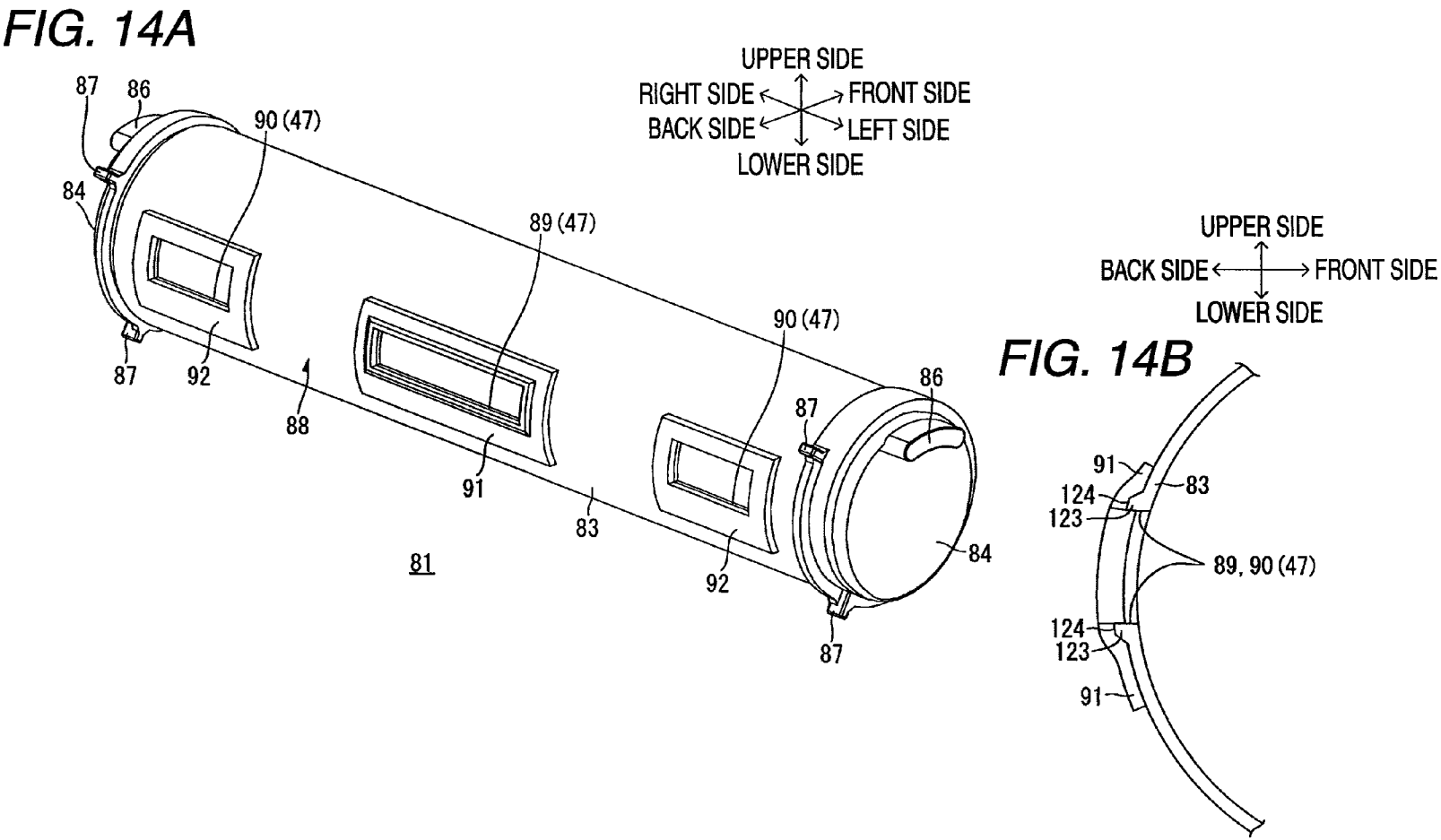
FIGS. 14A and 14B are a perspective view and a partial side sectional view of the developer cartridge according to the third exemplary embodiment of the invention.

FIGS. 13A and 13B are a perspective view and a partial side sectional view, respectively, of a developer cartridge according to a third exemplary embodiment of the invention. The views in FIGS. 13A and 13B correspond to the views in FIGS. 7A and 7B, respectively. FIGS. 14A and 14B are a perspective view and a partial side sectional view, respectively, of the developer cartridge of the third exemplary embodiment. The views in FIGS. 14A and 14B correspond to the views in FIGS. 8A and 8B, respectively. In FIGS. 13A, 13B and 14A, 14B, elements corresponding to those of FIGS. 7A, 7B and 8A, 8B, respectively, are denoted by the same reference numerals and description thereof is omitted.

As shown in FIG. 13A and 13B, in the third exemplary embodiment, supply-side protrusion 123 as an example of a protrusion protruding toward the outside circumferential wall 97 is formed on the supply-side bonding surface 121. The supply-side protrusion 123 protrudes more than the surrounding area of the supply-side bonding surface 121.

The supply-side protrusion 123 has a rectangular frame shape along an opening edge of the inside supply opening 89 in the rear view. In other words, the supply-side protrusion 123 is provided at a periphery of the inside supply opening 89. The protruding amount of the supply-side protrusion 123 is set so that the supply-side seal 91 protrudes a same amount as the supply-side seal 91 in the first exemplary embodiment relative to the return-side seal 92, in the case where the supply-side seal 91 and the return-side seal 92 have the same thickness.

The surface of the supply-side protrusion 123 is formed as an approach surface 124 having a flat shape. The approach surface 124 has a width with which the inner circumferential end 110 of the supply-side seal 91 and the outer circumferential end 111 in the vicinity of the inner circumferential end 110 are bonded.

That is, in the third exemplary embodiment, the return-side bonding surface 122 is continuous from the surrounding portion 88 around the return-side bonding surface 122 without any unevenness and the supply-side bonding surface 121 is also continuous from the surrounding portion 88 around the supply-side bonding surface 121 without any unevenness. In other words, the return-side bonding surface 122 and the supply-side bonding surface 121 extend continuously and evenly from the surrounding of the first bonding surface. The supply-side protrusion 123 is disposed in the opening edge of the inside supply opening 89.

As shown in FIGS. 14A and 14B, in the third exemplary embodiment, the supply-side seal 91 and the return-side seal 92 having the same thickness are bonded to the supply-side bonding surface 121 and the return-side bonding surface 122, respectively. Accordingly, the supply-side seal 91 coating the approach surface 124 protrudes to the outside circumferential wall 97 more than the return-side seal 92.

Accordingly, since the approach surface 124 is disposed on the supply-side protrusion 123, the supply-side seal 91 bonded to the approach surface 124 can be made to approach the outside circumferential wall 97 more than the return-side seal 92 bonded to the return-side bonding surface 122 by the protruding amount of the supply-side protrusion 123. As a result, the supply-side contact pressure can be made to be greater than the return-side contact pressure by the protruding amount of the supply-side protrusion 123.

The supply-side protrusion 123 is formed along the opening edge of the inside supply opening 89. Accordingly, by enhancing the supply-side contact pressure at the opening edge of the inside supply opening 89 by the use of the supply-side protrusion 123, it is possible to reliably prevent the leakage of the developer. In contrast, since the supply-side contact pressure is reduced in the supply-side bonding surface 121 other than the opening edge of the inside supply opening 89, it is possible to further reduce the sliding resistance between the inside housing 81 and the outside housing 82. Therefore, the relative rotation of the inside housing 81 and the outside housing 82 can be secured, thereby further improving the operability.

IV. Fourth Exemplary Embodiment

Figures 15A, 15B:
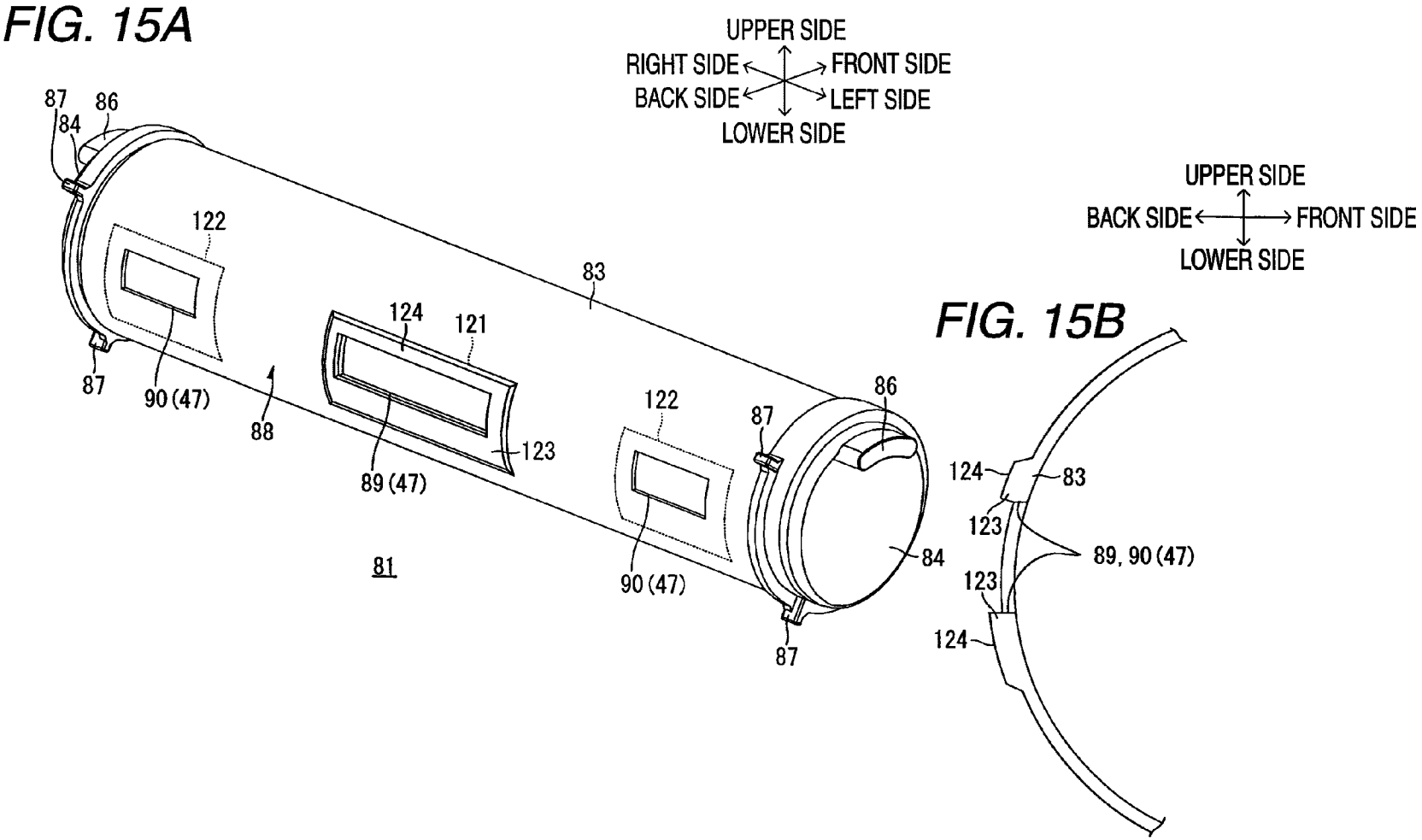
FIGS. 15A and 15B are a perspective view and a partial side sectional view of a developer cartridge according to a fourth exemplary embodiment of the invention.
Figures 16A, 16B:
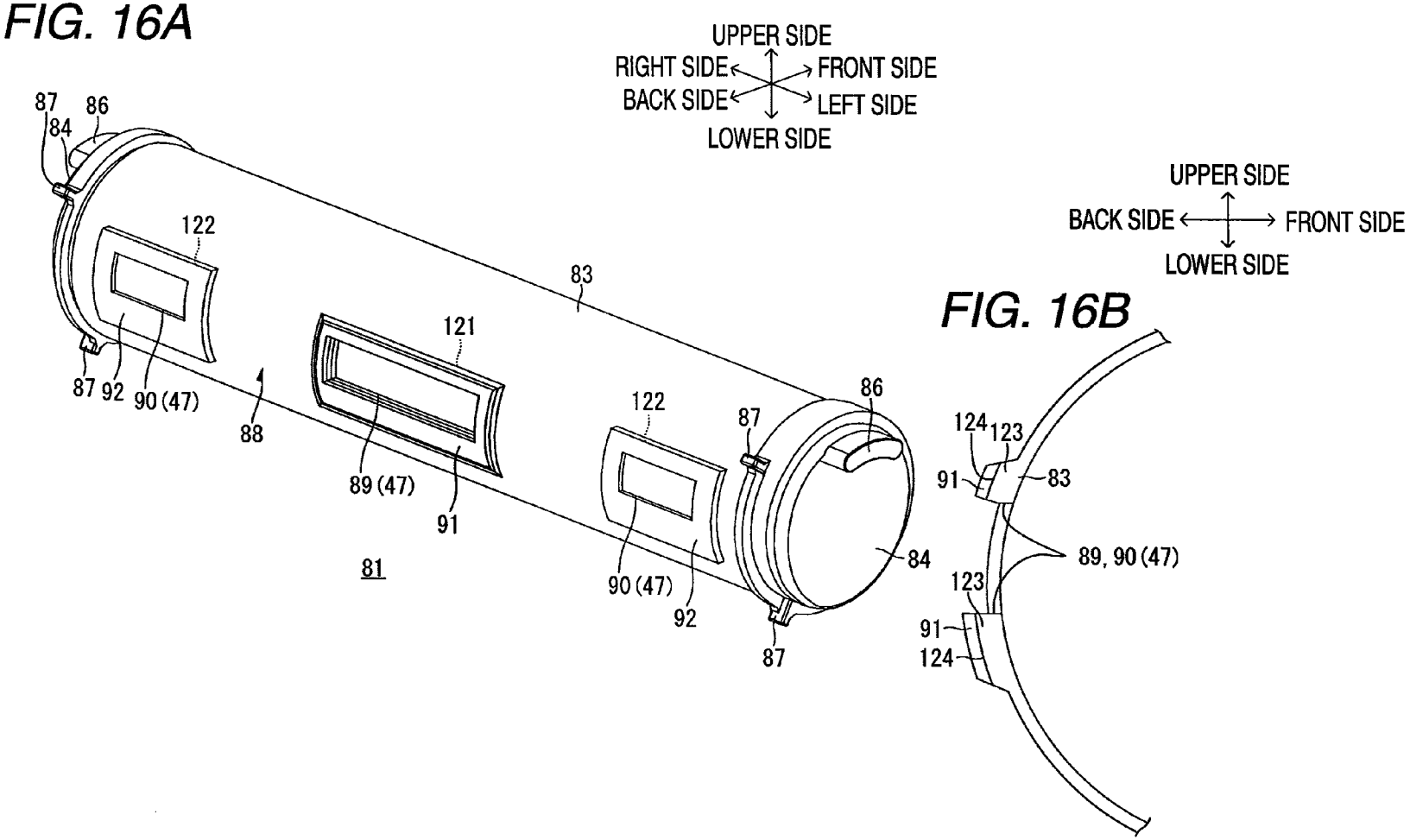
FIGS. 16A and 16B are a perspective view and a partial side sectional view of a developer cartridge according to the fourth exemplary embodiment of the invention.

FIGS. 15A and 15B are a perspective view and a partial side sectional view, respectively, of a developer cartridge according to a fourth exemplary embodiment of the invention. The views in FIGS. 15A and 15B correspond to the views in FIGS. 13A and 13B, respectively. FIGS. 16A and 16B are a perspective view and a partial side sectional view, respectively, of the developer cartridge of FIG. 15A. The views in FIGS. 16A and 16B correspond to the views in FIGS. 14A and 14B, respectively. In FIGS. 15A, 15B and 16A, 16B, elements corresponding to those of FIGS. 13A, 13B and 14A, 14B are denoted by the same reference numerals and description thereof is omitted.

As shown in FIGS. 15A and 15B, the supply-side protrusion 123 may alternatively be formed over the entire surface of the supply-side bonding surface 121. In this case, the approach surface 124 can be disposed over the entire surface of the supply-side bonding surface 121 and, as shown in FIGS. 16A and 16B, it is possible to further enhance the supply-side contact pressure by means of the supply-side seal 91 bonded to the approach surface 124. As a result, it is possible to further reliably prevent the leakage of the developer.

IV. Fifth Exemplary Embodiment

Figures 17A, 17B:
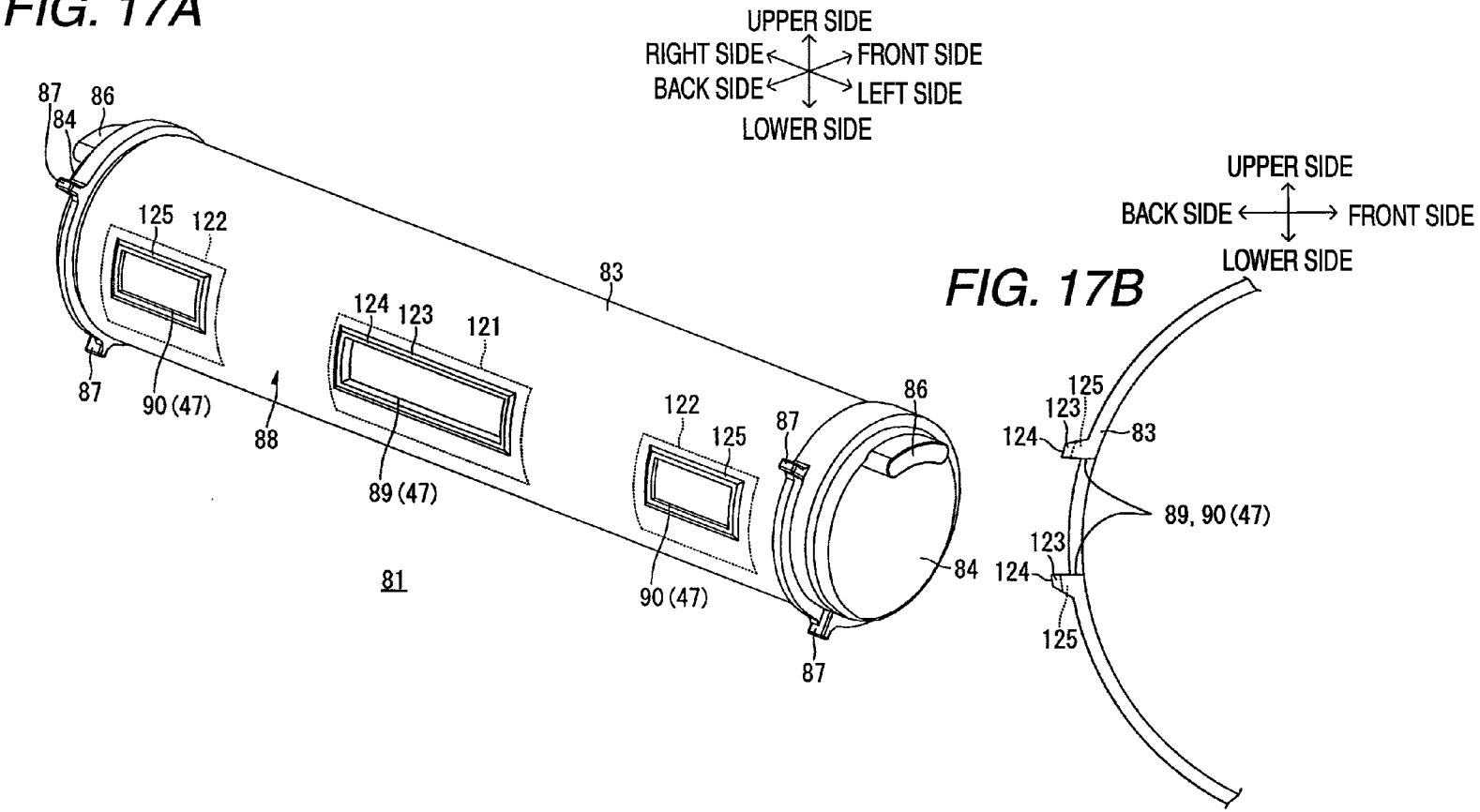
FIGS. 17A and 17B are a perspective view and a partial side sectional view of a developer cartridge according to a fifth exemplary embodiment of the invention.
Figures 18A, 18B:
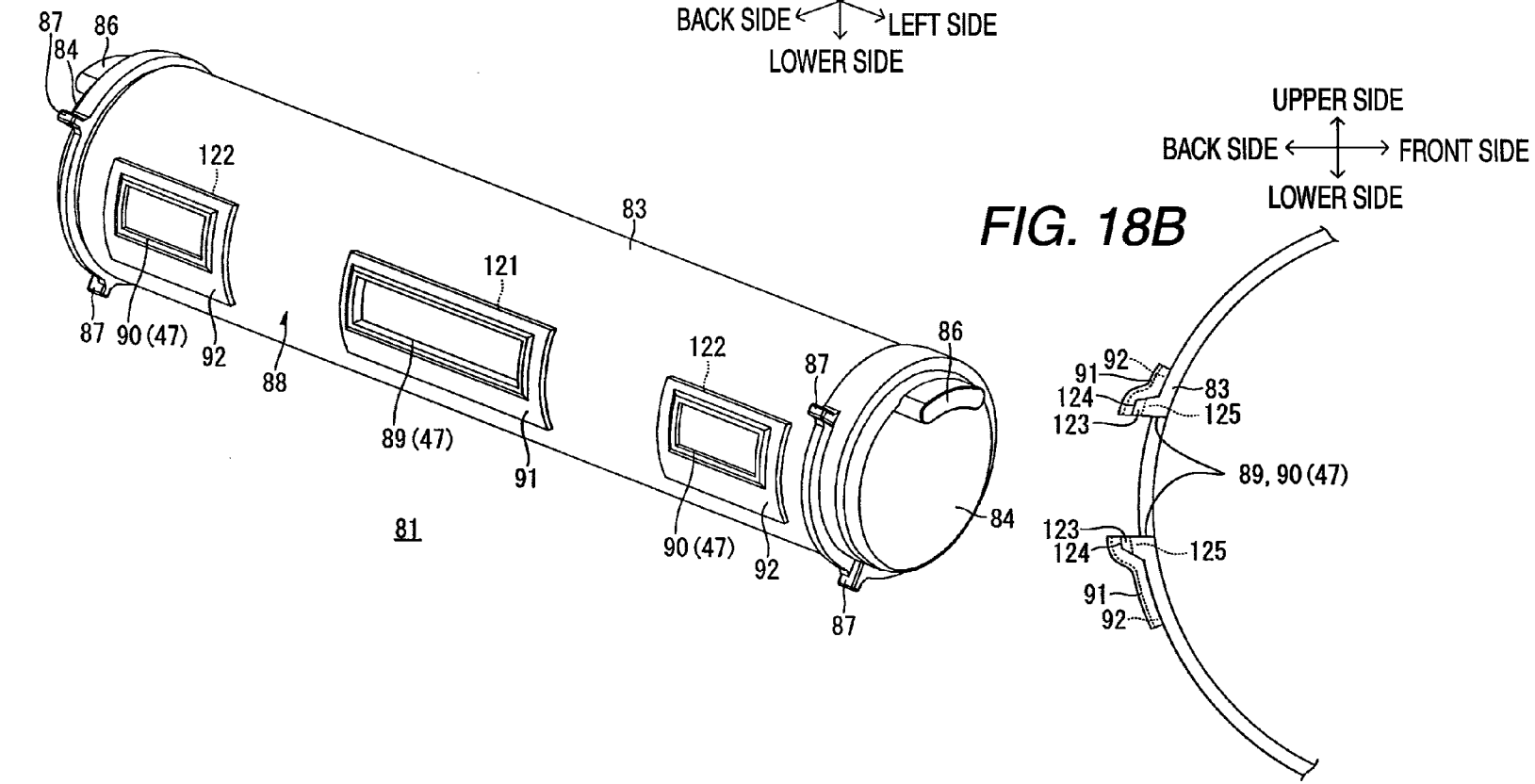
FIGS. 18A and 18B are a perspective view and a partial side sectional view of a developer cartridge according to the fifth exemplary embodiment of the invention.

FIGS. 17A and 17B are a perspective view and a partial side sectional view, respectively, of a developer cartridge according to a fifth exemplary embodiment of the invention. The views in FIGS. 17A and 17B correspond to the views in FIGS. 13A and 13B, respectively. FIGS. 18A and 18B are a perspective view and a partial side sectional view, respectively, of the developer cartridge of the fifth exemplary embodiment. The views in FIGS. 18A and 18B correspond to the views in FIGS. 14A and 14B, respectively. In FIGS. 17A, 17B and 18A, 18B, elements corresponding to those of FIGS. 13A, 13B and 14A, 14B are denoted by the same reference numerals and description thereof is omitted.

As shown in FIGS. 17A and 17B, in the fifth exemplary embodiment, the supply-side protrusion 123 is formed on the supply-side bonding surface 121 and a return-side protrusion 125 as an example of a protrusion protruding to the outside circumferential wall 97 more than the surrounding of the return-side bonding surface 122 is formed on the return-side bonding surface 122.

The return-side protrusion 125 has a rectangular frame shape along the opening edge of the inside return opening 90 in the rear view. The protruding amount of the return-side protrusion 125 is smaller than the protruding amount of the supply-side protrusion 123. That is, the supply-side protrusion 123 protrudes to the outside circumferential wall 97 more than the surrounding supply-side bonding surface 121 and more than the return-side protrusion 125. The surface of the return-side protrusion 125 is flat and has a width with which the inner circumferential end 110 of the return-side seal 92 and the outer circumferential end 111 in the vicinity of the inner circumferential end 110 are bonded.

As shown in FIGS. 18A and 18B, in the fifth exemplary embodiment, the supply-side seal 91 and the return-side seals 92 have the same thickness and are bonded to the supply-side bonding surface 121 and the return-side bonding surfaces 122, respectively. Accordingly, the supply-side seal 91 coating the approach surface 124 of the supply-side protrusion 123 protrudes to the outside circumferential wall 97 more than the return-side seal 92 coating the return-side protrusion 125.

Accordingly, the supply-side seal 91 bonded to the approach surface 124 protrudes to the outside circumferential wall 97 more than the return-side seal 92 bonded to the surrounding supply-side bonding surface 121 and the return-side protrusion 125. Therefore, by enhancing the return-side contact pressure of the return-side seal 92 and the supply-side contact pressure of the supply-side seal 91 by the use of the return-side protrusion 125 and the supply-side protrusion 123 and allowing the supply-side protrusion 123 to protrude to the outside circumferential wall 97 more than the return-side protrusion 125, it is possible to make the supply-side contact pressure of the supply-side seal 91 greater than the return-side contact pressure of the return-side seal 92.

VI. Sixth Exemplary Embodiment

Figure 19A:
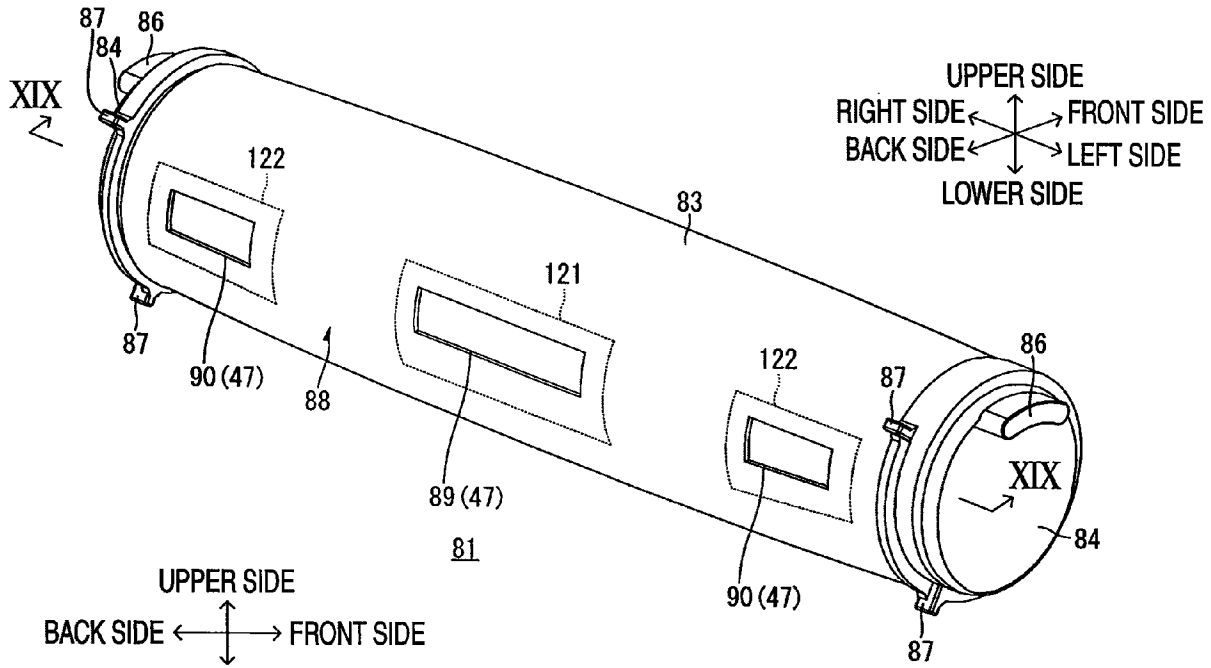
FIG. 19A is a perspective view of the process cartridge according to the first exemplary embodiment of the invention.
Figure 19B:
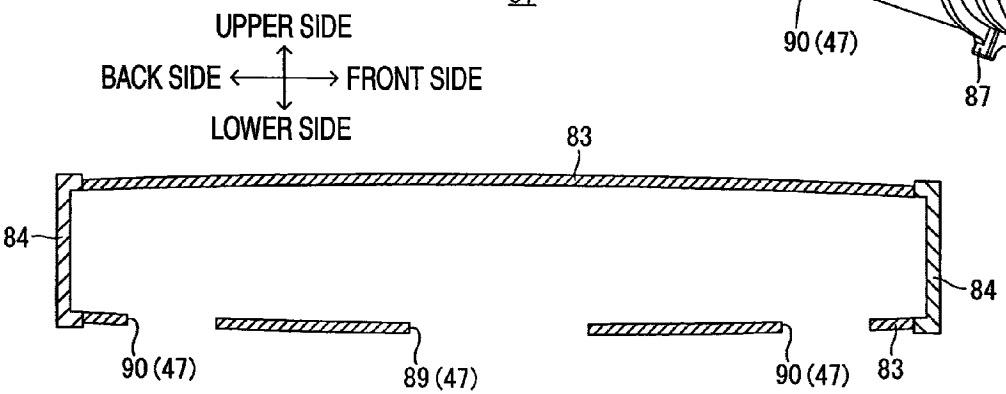
FIG. 19B is a cross-sectional view taken along line XIX-XIX of FIG. 19A.
Figure 20A:
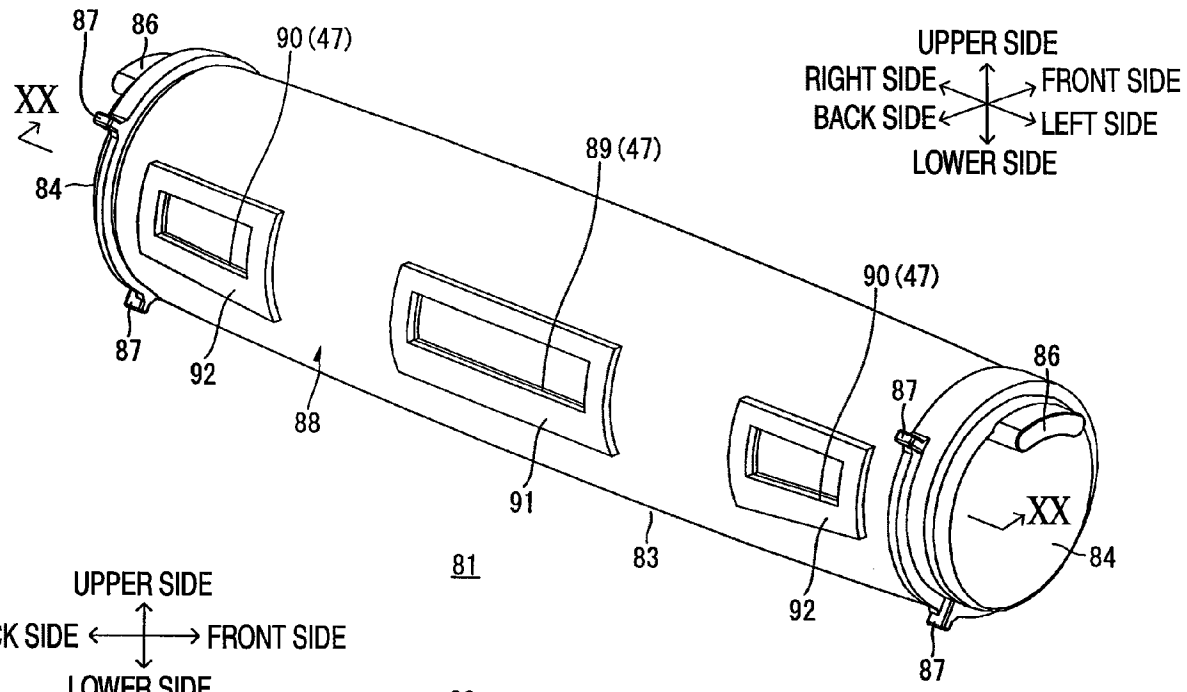
FIG. 20A is a perspective view according to the first exemplary embodiment of the invention.
Figure 20B:
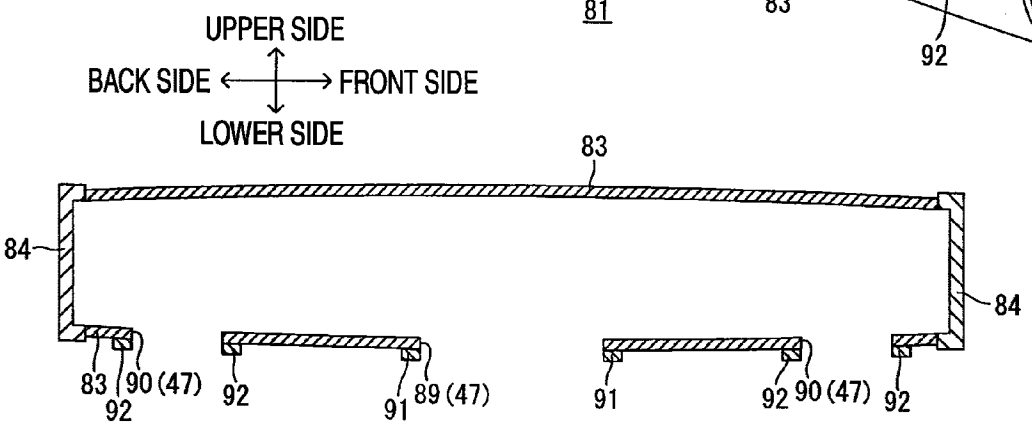
FIG. 20B is a cross-sectional view taken along line XX-XX of FIG. 20A.

FIG. 19A is a perspective view of a developer cartridge according to a sixth exemplary embodiment of the invention. The view in FIG. 19A corresponds to the view in FIG. 7A, and FIG. 19B is a cross-sectional view taken along line XIX-XIX of FIG. 19A. FIG. 20A is a perspective view of the developer cartridge according to the sixth exemplary embodiment. The view in FIG. 20A corresponds to the view in FIG. 8A, and FIG. 20B is a cross-sectional view taken along line XX-XX of FIG. 20A. In FIGS. 19A, 19B and 20A, 20B, elements corresponding to those of FIGS. 7A, 7B and 8A, 8B are denoted by the same reference numerals and description thereof is omitted.

As shown in FIG. 19, in the sixth exemplary embodiment, the inside circumferential wall 83 has a greater outer diameter at a center portion in the axis direction than the diameter at end portions of the inside circumferential wall 83 in the axis direction. Accordingly, in the axis direction, the center portion is thicker than the end portions. The inside supply opening 89 is disposed at the thicker center portion. In other words, the center portion of the wall of the developer cartridge bows slightly outward.

As shown in FIG. 20, in the sixth exemplary embodiment, the supply-side seal 91 and the return-side seal 92 have the same thickness and are bonded to the supply-side bonding surface 121 and the return-side bonding surface 122, respectively. Accordingly, the supply-side seal 91 protrudes to the outside circumferential wall 97 more than the return-side seal 92 due to the thickness difference between the end portions and the center portion. As a result, it is possible to simply and reliably make the supply-side contact pressure of the supply-side seal 91 greater than the return-side contact pressure of the return-side seal 92.

VII. Modified Exemplary Embodiments

(1) First Modification to the Exemplary Embodiments

The first to sixth exemplary embodiments have been independently described, but the first to sixth exemplary embodiments may be combined.

In the above-mentioned exemplary embodiments, in the inside housing 81, the inside supply opening 89 is formed at the center portion in the width direction and the inside return openings 90 are formed at both sides in the width direction. In addition, in the outside housing 82, the outside supply opening 108 is formed at the center portion in the width direction and the outside return openings 109 are formed at both sides in the width direction.

However, so long as the inside supply opening 89 can be opposed to the outside supply opening 108 and the inside return openings 90 can be opposed to the outside return openings 109, the positions thereof in the width direction are not particularly limited. For example, in the inside housing 81 and the outside housing 82, the inside supply opening 89 and the outside supply opening 108 may be formed at one side in the width direction and the inside return opening 90 and the outside return opening 109 may be formed at the other side in the width direction.

(2) Second Modification to the Exemplary Embodiments

In the above-described exemplary embodiments, the supply-side seal 91 and the return-side seal 92 are bonded to the supply-side bonding surface 121 and the return-side bonding surface 122 defined on the outer circumferential surface of the inside circumferential wall 83, respectively.

However, the supply-side bonding surface 121 may alternatively be defined around the outside supply opening 108 on the inner circumferential surface of the outside circumferential wall 97 and the return-side bonding surface 122 may alternatively be defined around the outside return opening 109. Accordingly, the supply-side seal 91 and the return-side seal 92 may be bonded to the supply-side bonding surface 121 and the return-side bonding surface 122, respectively, on the inner circumferential surface of the outside circumferential wall 97.

(3) Third Modification to the Exemplary Embodiments

In the above-described exemplary embodiments, the inside housing 81 rotates relative to the outside housing 82. Instead, the outside housing 82 may be made to rotate relative to the inside housing 81.

Specifically, when the outer housing 82 rotates between the opened position and the closed position and the outside housing 82 is located at the opened position, the inside supply opening 89 is opposed to the outside supply opening 108 and the inside return opening 90 is opposed to the outside return opening 109. In contrast, when the outside housing 82 is located at the closed position, the inside supply opening 89 and the inside return opening 90 are closed in portions on the outside circumferential wall 97 other than the outside supply opening 108 and the outside return opening 109.

(4) Fourth Modification to the Exemplary Embodiments

In the above-described exemplary embodiments, as shown in FIG. 1, the process cartridge 17 monolithically has the photosensitive drum 25 and the developing roller 37 in the developing part 32. However, the process cartridge 17 may include a developing cartridge having the developing roller 37 and a drum cartridge to which the developing cartridge is detachably attached and which has the photosensitive drum 25.

The photosensitive drum 25, the scorotron-type charger 26, and the transfer roller 28 may be disposed in the body casing 2, the process cartridge 17 may be constructed by the developing cartridge, and the developing cartridge may be detachably attached to the body casing 2.

(5) Fifth Modification of the Exemplary Embodiments

Although exemplary embodiments of the inventive concept have been described in relation to a laser printer, the present inventive concept is not limited to a monochrome laser printer. Rather, the present inventive concept can also be applied to a color laser printer, including a tandem type and an intermediate transfer type printer.

According to another aspect of the invention, the inside frame is rotatable with respect to the outside frame between the open position and the closed position.

According to still another aspect of the invention, a thickness of the second sealing member is greater than a thickness of the first sealing member.

According thereto, since the thickness of the second sealing member is greater than that of the first sealing member, the second contact pressure of the second sealing member can be simply and reliably made to be greater than the first contact pressure of the first sealing member.

According to still another aspect of the invention, a hardness of the second sealing member is greater than that of the first sealing member.

According thereto, since the hardness of the second sealing member is greater than that of the first sealing member, the repulsive power of the second sealing member against the first frame and the second frame can be made to be greater than that of the first sealing member against the first frame and the second frame. Accordingly, the second contact pressure of the second sealing member can be simply and reliably made to be greater than the first contact pressure of the first sealing member.

According to still another aspect of the invention, either one of the inside frame and the outside frame comprises: a first bonding surface to which the first sealing member is bonded; and a second bonding surface to which the second sealing member is bonded.

Further, according to still another aspect of the invention, the first bonding surface extends continuously and evenly in an area surrounding the first bonding surface, and the second bonding surface comprises a protrusion which protrudes from an area surrounding the second bonding surface.

Further, according to still another aspect of the invention, the protrusion comprises an approach surface on a top thereof.

According thereto, the first bonding surface to which the first sealing member is bonded and the second bonding surface to which the second sealing member is bonded are disposed in any one of the first frame and the second frame and the second bonding surface includes the approach surface approaching the opposite side more than the first bonding surface. Since the second sealing member bonded to the approach surface approaches the opposite side more than the first sealing member bonded to the first bonding surface, it is possible to reliably make the second contact pressure greater than the first contact pressure as much.

Further, the first bonding surface is formed continuous from the surrounding thereof without any unevenness and the second bonding surface includes the protrusion protruding to the opposite side more than the surrounding and having the approach surface disposed thereon. Since the approach surface is disposed on the protrusion, it is possible to allow the second sealing member to approach the opposite side more than the first sealing member by the protruding amount of the protrusion. As a result, it is possible to make the second contact pressure greater than the first contact pressure by the protruding amount of the protrusion.

According to still another aspect of the invention, the first bonding surface comprises a return-side protrusion protruding more than an area surrounding the first bonding surface, and the second bonding surface comprises a supply-side protrusion protruding more than both an area surrounding the second bonding surface and the return-side protrusion. The supply-side protrusion comprises an approach surface on a top thereof.

According thereto, the protrusion of the second bonding surface having the approach surface disposed thereon protrudes to the opposite side more than the surrounding of the second bonding surface and the protrusion of the first bonding surface. Accordingly, it is possible to enhance the first contact pressure of the first sealing member and the second contact pressure of the second sealing member by the use of the protrusion of the first bonding surface and the protrusion of the second bonding surface, and it is also possible to make the second contact pressure of the second sealing member greater than the first contact pressure of the first sealing member by allowing the protrusion of the second bonding surface to protrude to the opposite side more than the protrusion of the first bonding surface.

According to still another aspect of the invention, the protrusion is provided at a periphery of the inside supply opening.

Further, according to still another aspect of the invention, the return-side protrusion is provided at a periphery of the inside return opening, and the supply-side protrusion is provided at a periphery of the inside supply opening.

According thereto, the protrusion is disposed a periphery of the inside supply opening or both the inside supply opening and the inside return opening. Accordingly, the second contact pressure or both the first contact pressure and the second contact pressure at the opening ends can be enhanced by the protrusion, thereby preventing the leakage of the developer. In contrast, since the second contact pressure or both the first contact pressure and the second contact pressure are reduced at positions other than the opening ends, it is possible to reduce the sliding resistance between the first frame and the second frame. Accordingly, it is possible to improve the operability.

According to still another aspect of the invention, the protrusion is provided over an entire surface of the second bonding surface.

Further, according to still another aspect of the invention, the return-side protrusion is provided on an entire surface of the first bonding surface, and the supply-side protrusion is provided on an entire surface of the second bonding surface.

According thereto, the protrusion is disposed on the entire surface of the second bonding surface or both the first bonding surface and the second bonding surface. Accordingly, it is possible to further enhance the second contact pressure of the second sealing member or both the first contact pressure of the first sealing member and the second contact pressure of the second sealing member. As a result, it is possible to reliably prevent the leakage of the developer.

According to still another aspect of the invention, a center portion in a longitudinal direction of the inside frame is thicker in the direction perpendicular to the longitudinal direction than end portions of the inside frame in the longitudinal direction, and the inside supply opening is provided in the center portion in the longitudinal direction of the inside frame.

According thereto, the center portion in the longitudinal direction of the first frame is thicker than both end portions in the longitudinal direction. Accordingly, it is possible to simply and reliably make the second contact pressure of the second sealing member greater than the first contact pressure of the first sealing member.

According to still another aspect of the invention, wherein the inside frame comprises an agitator for agitating the developer, and wherein the agitator comprises: a rotation shaft which extends in an axial direction and is rotatably supported by the inside frame; a tilt agitation plate provided on the rotation shaft so that a downstream end portion in the rotation direction of the rotation shaft is located closer to the inside supply opening than an upstream end portion thereof and so that the tilt agitation plate is tilted about the rotation direction and the axis direction of the rotation shaft; and an agitation blade that is bent toward the downstream side in the rotation direction along the inside surface of the inside frame, rotating to be opposed to the inside supply opening, and is provided on the rotation shaft.

According thereto, with the rotation of the rotation shaft, the tilt agitation plate transports the developer to the inside supply opening and the agitation blade supplies the developer from the inside supply opening to the outside in the rotation direction of the rotation shaft. Since the agitation blade is bent to the downstream in the rotation direction along the inside surface of the first frame, the bending is released at the time of supplying the developer from the inside supply opening to the outside and the developer leaps to the inside supply opening and is thus supplied strongly to the outside. Accordingly, it is possible to reliably supply the developer from the inside supply opening to the outside.

In contrast, as described above, when the developer leaps to the inside supply opening by the agitation blade, the developer is easily attached to the second sealing member.

However, the second contact pressure of the second sealing member is set to be greater than the first contact pressure of the first sealing member. Accordingly, for example, when the developer is attached to the second sealing member, the developer can be prevented from leaking between the first frame and the second frame.

What is claimed is:

1. A developer cartridge comprising:

an outside frame comprising:

an outside supply opening, and an outside return opening;

an inside frame, one of the inside frame and the outside frame being rotatable with respect to another one of the inside frame and the outside frame between an open position and a closed position, the inside frame comprising:

a developer chamber for accommodating a developer;

an inside supply opening, which is opposed to the outside supply opening when the one of the inside frame and the outside frame is in the open position, for supplying the developer from the developer chamber to an outside of the developer chamber; and an inside return opening, which is opposed to the outside return opening when the one of the inside frame and the outside frame is in the open position, for returning the developer from the outside to an inside of the developer chamber;

a first sealing member that is provided around one of the inside return opening and the outside return opening between the inside frame and the outside frame and is contactable with the inside frame and the outside frame with a first contact pressure; and a second sealing member that is provided around one of the inside supply opening and the outside supply opening between the inside frame and the outside frame and is contactable with the inside frame and the outside frame with a second contact pressure that is greater than the first contact pressure.

2. The developer cartridge according to claim 1, wherein the inside frame is rotatable with respect to the outside frame between the open position and the closed position.

3. The developer cartridge according to claim 1, wherein a thickness of the second sealing member is greater than a thickness of the first sealing member.

4. The developer cartridge according to claim 1, wherein a hardness of the second sealing member is greater than that of the first sealing member.

5. The developer cartridge according to claim 1, wherein either one of the inside frame and the outside frame comprises:

a first bonding surface to which the first sealing member is bonded; and a second bonding surface to which the second sealing member is bonded.

6. The developer cartridge according to claim 5, wherein the first bonding surface extends continuously and evenly in an area surrounding the first bonding surface, and wherein the second bonding surface comprises a protrusion which protrudes from an area surrounding the second bonding surface.

7. The developer cartridge according to claim 6, wherein the protrusion is provided at a periphery of the inside supply opening.

8. The developer cartridge according to claim 6, wherein the protrusion is provided over an entire surface of the second bonding surface.

9. The developer cartridge according to claim 6, wherein the protrusion comprises an approach surface on a top thereof.

10. The developer cartridge according to claim 5, wherein the first bonding surface comprises a return-side protrusion protruding more than an area surrounding the first bonding surface, and wherein the second bonding surface comprises a supply-side protrusion protruding more than both an area surrounding the second bonding surface and the return-side protrusion.

11. The developer cartridge according to claim 10, wherein the return-side protrusion is provided at a periphery of the inside return opening, and wherein the supply-side protrusion is provided at a periphery of the inside supply opening.

12. The developer cartridge according to claim 10, wherein the return-side protrusion is provided on an entire surface of the first bonding surface, and wherein the supply-side protrusion is provided on an entire surface of the second bonding surface.

13. The developer cartridge according to claim 10, wherein the supply-side protrusion comprises an approach surface on a top thereof.

14. The developer cartridge according to claim 1, wherein a center portion in a longitudinal direction of the inside frame is thicker in the direction perpendicular to the longitudinal direction than end portions of the inside frame in the longitudinal direction, and wherein the inside supply opening is provided in the center portion in the longitudinal direction of the inside frame.

15. The developer cartridge according to claim 1, wherein the inside frame comprises an agitator for agitating the developer, and wherein the agitator comprises:

a rotation shaft which extends in an axial direction and is rotatably supported by the inside frame;

a tilt agitation plate provided on the rotation shaft so that a downstream end portion in the rotation direction of the rotation shaft is located closer to the inside supply opening than an upstream end portion thereof and so that the tilt agitation plate is tilted about the rotation direction and the axis direction of the rotation shaft; and an agitation blade that is bent toward the downstream side in the rotation direction along the inside surface of the inside frame, rotating to be opposed to the inside supply opening, and is provided on the rotation shaft.

16. A developing device comprising:

the developer cartridge according to claim 1; and a housing comprising:

a cartridge housing part to which the developer cartridge is detachably attached; and a developing part comprising a developer holding member that comprises openings formed to be opposed to the inside supply opening and the inside return opening, the developing part configured to receive the developer supplied through the inside supply opening and the openings.

17. An image forming apparatus comprising:

the developing device according to claim 16; and a body casing for housing the developing device.

* * * * *